US005878312A

United States Patent [19]

Hisada

[11] Patent Number: 5,878,312

[45] Date of Patent: Mar. 2, 1999

[54] IMAGE FORMING DEVICE WITH LEVELING UNIT HAVING A WIDTH EQUAL TO OR LESS THAN A PREDETERMINED DISTANCE

[75] Inventor: Hidenori Hisada, Tokoname, Japan

[73] Assignee: Brother Kogyo Kabushiki Kaisha, Nagoya, Japan

[21] Appl. No.: 855,112

[22] Filed: May 13, 1997

[30] Foreign Application Priority Data

May 16, 1996 [JP] Japan ..... 8-122027
May 16, 1996 [JP] Japan ..... 8-122028
May 16, 1996 [JP] Japan ..... 8-122029

[51] Int. Cl.[6] ..... G03G 21/00; G03G 15/22; G03G 15/08

[52] U.S. Cl. ..... 399/149; 399/98; 399/343

[58] Field of Search ..... 399/149, 18, 343, 399/98, 99, 100, 101

[56] References Cited

U.S. PATENT DOCUMENTS 5,321,471 6/1994 Ito et al. ..... 399/149
5,606,408 2/1997 Yano et al. ..... 399/343
5,740,494 4/1998 Shoji et al. ..... 399/71

*Primary Examiner*—Arthur T. Grimley
*Assistant Examiner*—Quana Grainger
*Attorney, Agent, or Firm*—Oliff & Berridge, PLC

[57] ABSTRACT

An image forming device includes: a photosensitive drum that rotates in a rotational direction; a scanner unit that forms an electrostatic latent image on the photosensitive body; a developing unit that has an operating condition for developing the electrostatic latent image using toner; a transfer unit that transfers the toner image from the photosensitive body to the recording body; a cleaning roller disposed downstream from the transfer unit with respect to the rotational direction at a predetermined leveling position adjacent to the photosensitive body and having an adsorption mode, wherein the cleaning roller uses the potential difference between itself and the photosensitive drum to adsorb residual toner from the photosensitive drum, and a release mode, wherein the cleaning roller uses the potential difference between itself and the photosensitive drum to release residual toner back onto the photosensitive drum; and a controller for switching the cleaning roller into its adsorption mode when a lead edge of an image forming portion of the photosensitive body reaches the leveling position.

30 Claims, 13 Drawing Sheets

FIG. 12(a) TIME : t0
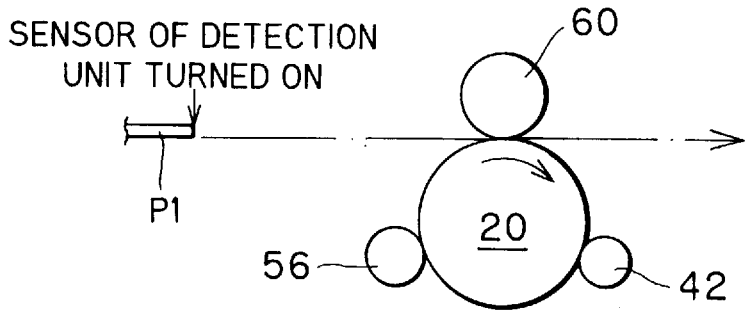
FIG. 12(b) TIME : t0 + Tsb
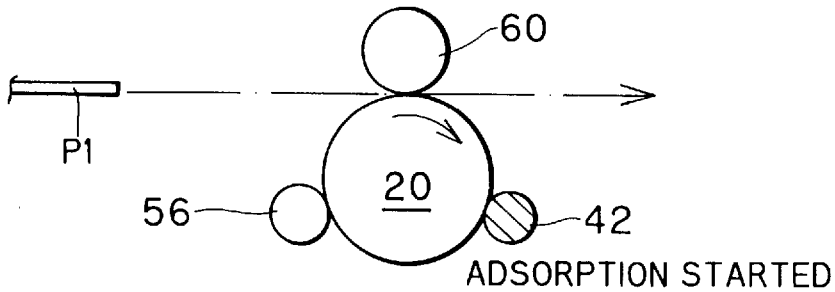
FIG. 12(c) TIME : t0 + Tse
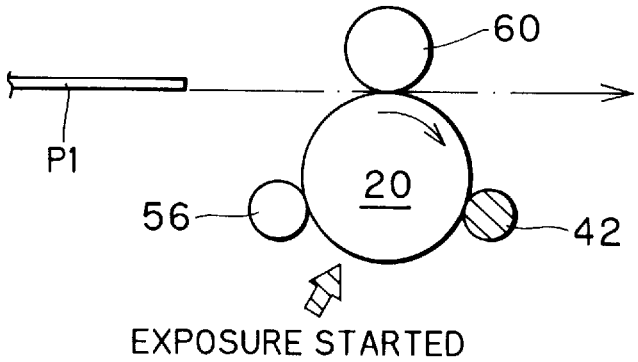
FIG. 12(d) TIME : t0 + Tsd
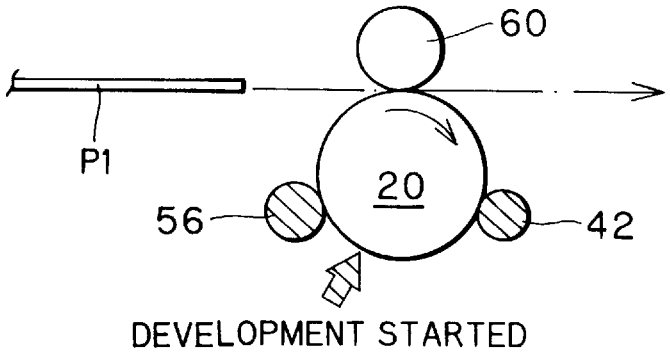

FIG. 12(e) TIME : t1
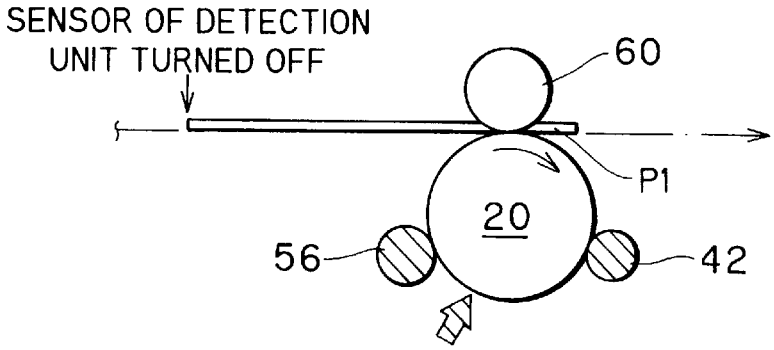
FIG. 12(f) TIME : t1 + Tsb
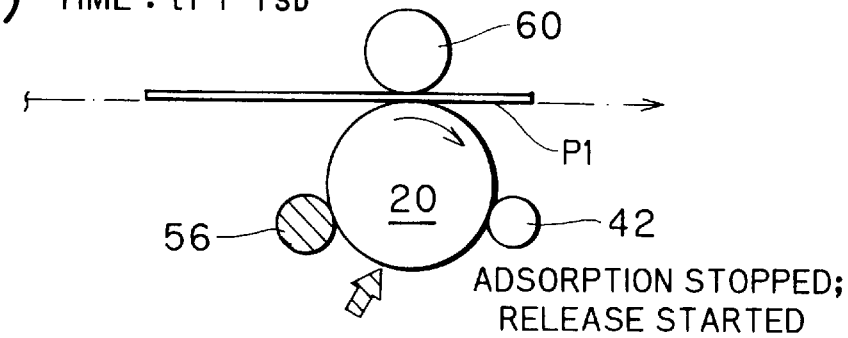
FIG. 12(g) TIME : t1 + Tse
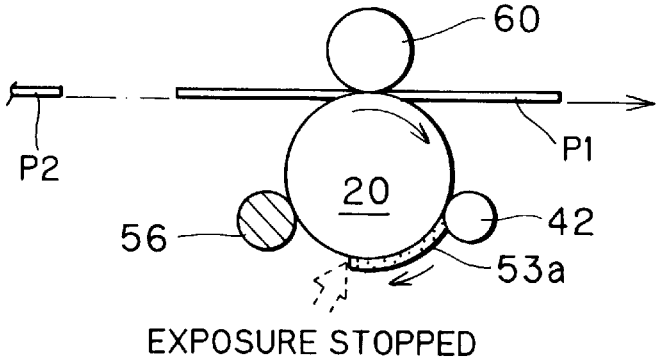
FIG. 12(h) TIME : t1 + Tsb + ΔT3
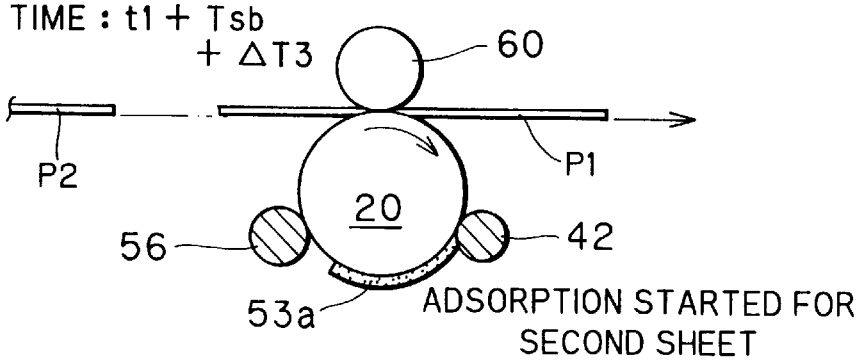

FIG. 12(i) TIME : t1 + Tsd
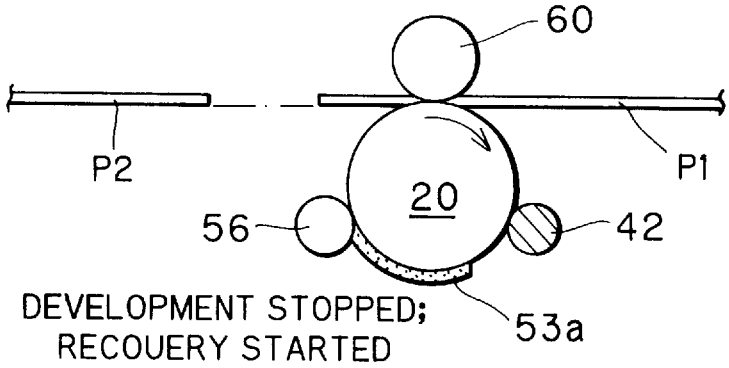
FIG. 12(j) TIME : t1 + Tse + ΔT4
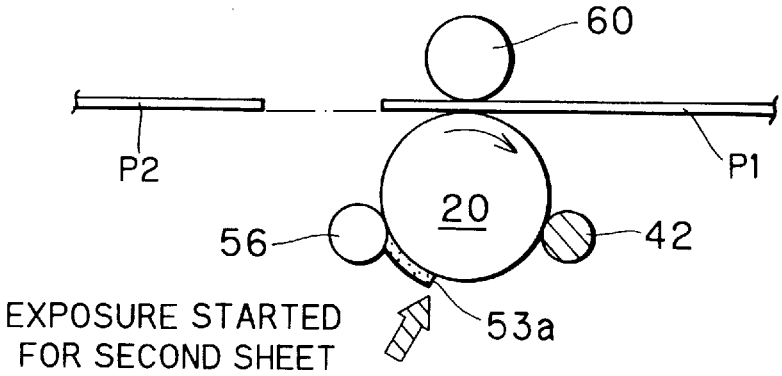
FIG. 12(k) TIME : t1 + Tsd + ΔTS
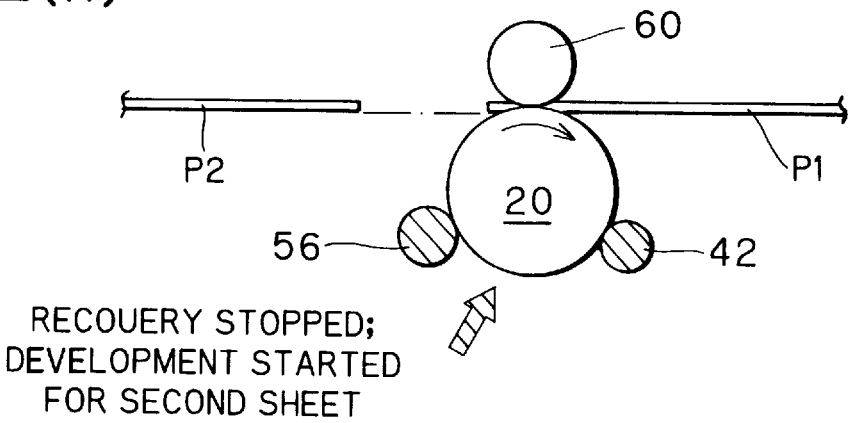

IMAGE FORMING DEVICE WITH LEVELING UNIT HAVING A WIDTH EQUAL TO OR LESS THAN A PREDETERMINED DISTANCE

BACKGROUND OF THE INVENTION

1. Field of the Invention

The present invention relates to an electrophotographic image forming device used in printers, copy machines, and facsimile machines and more particularly to a cleanerless image forming device wherein a photosensitive drum is cleaned using a cleanerless method.

2. Description of the Related Art

Electrophotographic type image forming devices are provided with: a photosensitive drum; a charge device for forming a uniform charge on the surface of the photosensitive drum; an exposure unit for exposing the surface of the photosensitive drum with light to form an electrostatic latent image; a developing unit for developing the electrostatic latent image using toner charged with a predetermined positive or negative polarity, thereby forming a toner image on the surface of the photosensitive drum; and a transfer roller for transferring the toner image to a recording sheet.

After the toner image is transferred onto the recording sheet, some toner, depending on the density of the toner image, will remain untransferred on the surface of the photosensitive drum. During the next cycle of charging, exposure development, and transfer of a subsequent image on the photosensitive drum, this residual toner clinging to the surface of the photosensitive drum might be transferred to the next recording sheet where it is not required, thereby reducing the quality of the recorded image on the recording sheet.

Conventionally, a cleaner mechanism is provided to clean the residual toner off the photosensitive drum. One example of a cleaner mechanism is a blade for scraping residual toner from the surface of the photosensitive drum after completion of transfer processes. An alternative to a cleaner mechanism is a cleanerless method of forming images, wherein residual toner is recovered and reused by the development device.

In the cleanerless method, some type of leveling unit, such as a cleaning roller or a cleaning brush, is disposed in confrontation with the photosensitive drum at a position downstream from the transfer roller, that is, with respect to the rotational direction of the photosensitive drum. The leveling unit is capable of an adsorption mode, wherein it electrically adsorbs the residual toner from the photosensitive drum onto its surface, and also a release mode, wherein it releases the adsorbed toner from its surface back to the surface of the photosensitive drum.

The leveling unit enters its adsorption mode while image forming processes are being performed using the surface of the photosensitive drum. In order to periodically retrieve toner using the cleanerless system, the leveling unit enters its release mode while image forming processes are not being performed on the surface of the photosensitive drum, usually between supply. of sheets to the photosensitive drum. The toner returned to the surface of the photosensitive drum is transported to the developing unit of the image forming device by rotation of the photosensitive drum.

A cleanerless method which uses such a leveling unit is very effective. Even if positively or negatively charged toner remains on the surface of the photosensitive drum, the surface of the photosensitive drum can be sufficiently cleaned so that quality of images formed on the photosensitive drum can be maintained. Also, the residual toner is collected by the development roller and can be again used during subsequent development processes.

Because the leveling unit adsorbs residual toner from the surface of the photosensitive drum while images are being formed and releases the adsorbed toner back to the photosensitive drum while images are not being formed, the leveling means can maintain a high level of cleaning for long periods of time. As a result, the photosensitive drum can be maintained in a clean condition so that reductions in image quality caused by residual toner can be prevented.

SUMMARY OF THE INVENTION

However, according to this cleanerless method, even when the toner used in development is supposed to be charged with a positive polarity, actually some negatively charged toner particles, although only minute amounts, also exist in the toner. Such toner which is charged to a polarity opposite of the desired polarity will be referred to as opposite polarity toner hereinafter. Opposite polarity toner includes toner adsorbed on the cleaning roller during the release mode of the cleaning roller, toner clinging to the cleaning roller via Van der Waals forces, and toner whose charge was reversed by friction against the cleaning roller. During the adsorption mode of the leveling unit, the static electric force used for adsorbing toner charged with a predetermined polarity will actually release the opposite polarity toner from the leveling unit onto the surface of the photosensitive drum.

A conceivable example wherein a cleaning roller is used as the leveling unit will be provided while referring to FIG. 1. It should be noted that the timing chart of FIG. 1 uses the surface of the photosensitive drum as its standard to facilitate understanding of the timing difference between the cleaning position and the development position.

During the cleaning process, the cleaning roller is switched to its adsorption mode, which is actually the release mode for the opposite polarity toner. The cleaning roller supplies a particularly large amount of opposite polarity toner during its first complete turn, which corresponds to the time duration Δ T1' in FIG. 1. As a result, during the time duration Δ T2', the next cycle of charging, exposure, and development processes will be performed on a portion of the photosensitive drum covered with the opposite polarity of toner released from the cleaning roller during the time duration Δ T1'. Because of this opposite polarity toner, the image developed on this portion of the photosensitive drum during a develop time Δ T2' will have poor quality.

When toner adhering to the leveling unit is to be retrieved by putting the leveling unit into its release mode between supply of sheets to the photosensitive drum, the time between supply of successive sheets must be lengthened to a sufficiently long duration to enable proper recovery of the residual toner from the leveling unit. During this duration of time, image forming processes on the surface of the photosensitive drum must be temporarily stopped. When a plurality of images are to be formed in succession, such as during consecutive printing operations or copy operations in a copy machine, this long inter-sheet interval can reduce the overall image forming speed. For example, in a device for printing six A4 sized sheets per minute, the distance between supplied sheets can be about 50 mm. However, when the inter-sheet interval needs to be greater than this in order to adsorb toner from the surface of the photosensitive drum, then it becomes impossible to print six sheets per minute.

A great deal of toner can cling to the leveling unit during some circumstances other than normal operations, such as after image forming operations are restarted after correction of a paper jam, after normal operations are stopped for a long period of time, or after power of the image forming device is turned on. When the leveling unit has a great deal of toner accumulated thereon, its cleaning performance is degraded so that images formed by the image forming device will be temporarily formed with an inferior quality.

It is an objective of the present invention to overcome the above-described problems and to provide an image forming device wherein image quality is not reduced by the presence of opposite polarity developing agent clinging to the surface of the photosensitive body.

It is another objective of the present invention to provide an image forming device capable of maintaining a photosensitive drum in a clean condition so that high quality images can be obtained during normal operations after paper jams, after operations are stopped for long periods of time, and directly after power of the image forming device is turned on.

It is still another objective of the present invention to enable consecutive formation of images on recording media and recovering toner or other developing agent without reducing image forming speed of the device.

In order to achieve the above described objectives, an image forming device according to the present invention is for forming an image on a recording medium from developing agent charged to a predetermined polarity and includes: a photosensitive body that rotates in a rotational direction, the photosensitive body having an image forming region in which the image is to be formed; a latent image forming unit that forms an electrostatic latent image on the photosensitive body; a developing unit that has an operating condition, wherein the developing unit develops the electrostatic latent image on the photosensitive body using the developing agent to form a developing agent image on the photosensitive body, and a non-operating condition, wherein the developing unit recovers the developing agent from the photosensitive body; a transfer unit that transfers the developing agent image from the photosensitive body to the recording body; a leveling unit disposed at a predetermined leveling position downstream from the transfer unit with respect to the rotational direction and having a predetermined width with respect to the rotational direction of the photosensitive body, the leveling unit having an adsorption mode, wherein the leveling unit utilizes potential difference between the leveling unit and the photosensitive body to adsorb developing agent remaining on the photosensitive body after transfer operations by the transfer unit, and a release mode, wherein the leveling unit utilizes potential difference between the leveling unit and the photosensitive body to release developing agent adsorbed during the adsorption mode onto the photosensitive body; and a switching unit that switches the leveling unit into its adsorption mode when the image forming region of the photosensitive body is rotated to within at least the predetermined width distance from the leveling position.

With this configuration, the latent image forming unit forms an electrostatic latent image on the photosensitive body. Then, the developing unit, while in its operating condition, develops the electrostatic latent image using developing agent charged to a predetermined polarity. As a result, the developing agent image will be formed on the surface of the photosensitive body. Next, the transfer unit transfers the developing agent image onto a recording body. Afterward, the leveling unit in its adsorption mode uses the potential differences between the photosensitive body and the residual developing agent, which remains on the surface of the photosensitive body after the transfer operation, to adsorb the residual toner from the surface of the photosensitive body at a predetermined leveling position disposed downstream from the transfer unit with respect to rotational direction of the photosensitive body. Then, in its release mode, the leveling unit uses potential difference between the photosensitive body and the residual developing agent adsorbed by the leveling unit during its adsorption mode to release the adsorbed developing agent back onto the surface of the photosensitive drum. The developing unit in its non-operating condition recovers developing agent leveled on the surface of the photosensitive drum. Here, the switching unit switches the leveling unit to its adsorption mode at a position at least a predetermined width of the leveling unit before the image forming region of the photosensitive body reaches the leveling position.

Accordingly, in the time between when the leveling unit is switched to its adsorption mode until when the image forming region reaches the leveling position, the opposite polarity developing agent clinging to the leveling unit will be supplied from the leveling unit around the entire width in the rotational direction of the photosensitive body. As a result, by the time the image forming region of the photosensitive body reaches the leveling unit, the leveling unit will be in a condition where it no longer supplies opposite polarity developing agent while in its adsorption mode.

According to another aspect of the present invention, an image forming device for forming image on a recording medium from developing agent charged to a predetermined polarity includes: a photosensitive body that rotates in a rotational direction; a latent image forming unit that forms an electrostatic latent image on the photosensitive body; a developing unit that has an operating condition, wherein the developing unit develops the electrostatic latent image on the photosensitive body using the developing agent to form a developing agent image on the photosensitive body, and a non-operating condition, wherein the developing unit recovers the developing agent from the photosensitive body; a transfer unit that transfers the developing agent image from the photosensitive body to the recording body; a leveling unit having a predetermined width with respect to the rotational direction of the photosensitive body and having an adsorption mode, wherein the leveling unit utilizes potential difference between the leveling unit and the photosensitive body to adsorb developing agent remaining on the photosensitive body after transfer operations by the transfer unit, and a release mode, wherein the leveling unit utilizes potential difference between the leveling unit and the photosensitive body to release developing agent adsorbed during the adsorption mode onto the photosensitive body; a detection unit that detects a predetermined condition in the image forming device; and a mode controlling unit that, when the detection unit detects the predetermined condition, sets the leveling unit into its release mode for at least the predetermined width and into its adsorption mode for at least the predetermined width.

With this configuration, when the detection unit detects a predetermined condition of the image forming device, such as a paper jam being corrected, the image forming device being stopped for long period of time, or the power source being turned on, then the leveling unit is put into its release mode for at least a predetermined width of the leveling unit and also put into its adsorption mode for at least a predetermined width.

Accordingly, whenever the detection unit detects a condition where there is a possibility that the leveling unit has accumulated a great deal of developing agent, then the leveling unit is placed into its release mode for the predetermined width so that developing agent imparted with a predetermined polarity will be released from the entire width of the leveling unit. The leveling unit is then placed into its adsorption mode for the predetermined width so that opposite polarity developing agent will be released from the entire width of the leveling unit. As a result, developing agent accumulated on the leveling unit during the predetermined condition of the image forming device will be sufficiently released from the leveling unit so that reduction in the cleaning function of the leveling unit due to the accumulated developing agent can be effectively prevented.

According to still another aspect of the present invention, an image forming device for forming an image on a recording medium from developing agent charged to a predetermined polarity includes: a photosensitive body that rotates in a rotational direction, the photosensitive body having an image forming portion in which an image corresponding to a single predetermined recording body is to be formed; latent image forming unit that forms an electrostatic latent image on the photosensitive body; a developing unit that has an operating condition, wherein the developing unit develops the electrostatic latent image on the photosensitive body using the developing agent to form a developing agent image on the photosensitive body, and a non-operating condition, wherein the developing unit recovers the developing agent from the photosensitive body; a transfer unit that transfers the developing agent image from the photosensitive body to the recording body; a leveling unit disposed at a predetermined leveling position downstream from the transfer unit with respect to the rotational direction of the photosensitive body and having an adsorption mode, wherein the leveling unit utilizes potential difference between the leveling unit and the photosensitive body to adsorb developing agent remaining on the photosensitive body after transfer operations by the transfer unit, and a release mode, wherein the leveling unit utilizes potential difference between the leveling unit and the photosensitive body to release developing agent adsorbed during the adsorption mode onto the photosensitive body; and a switching unit for switching the leveling unit into its adsorption mode when a lead edge of the image forming portion of the photosensitive body reaches the leveling position.

According to another aspect of the present invention, an image forming device for forming an image on a recording medium from developing agent charged to a predetermined polarity includes: a photosensitive body that rotates in a rotational direction, the photosensitive body having a first image forming portion in which an image corresponding to a first recording body is to be formed and a second image forming portion in which an image corresponding to a second recording body is to be formed; a latent image forming unit that forms an electrostatic latent image on the photosensitive body; a developing unit that has an operating condition, wherein the developing unit develops the electrostatic latent image on the photosensitive body using the developing agent to form a developing agent image on the photosensitive body, and a non-operating condition, wherein the developing unit recovers the developing agent from the photosensitive body; a transfer unit that transfers the developing agent image from the photosensitive body to the recording body; a leveling unit disposed at a predetermined leveling position downstream from the transfer unit with respect to the rotational direction and having a predetermined width with respect to the rotational direction of the photosensitive body, the leveling unit having an adsorption mode, wherein the leveling unit utilizes potential difference between the leveling unit and the photosensitive body to adsorb developing agent remaining on the photosensitive body after transfer operations by the transfer unit, and a release mode, wherein the leveling unit utilizes potential difference between the leveling unit and the photosensitive body to release developing agent adsorbed during the adsorption mode onto the photosensitive body; and a switching unit that switches the leveling unit into its adsorption mode when the first image forming region of the photosensitive body is rotated to within at least the predetermined width distance from the leveling position, that switches the leveling unit into its release mode when an end edge of the first image forming portion of the photosensitive body reaches the leveling position, and that switches the leveling unit into its adsorption mode when a lead edge of the second image forming portion of the photosensitive body reaches the leveling position.

BRIEF DESCRIPTION OF THE DRAWINGS

The above and other objects, features and advantages of the invention will become more apparent from reading the following description of the preferred embodiment taken in connection with the accompanying drawings in which:

FIGS. 12(*a*) through 12(*k*) are side views showing condition of image forming components during various times shown in the timing chart of FIG. 11.

DETAILED DESCRIPTION OF THE PREFERRED EMBODIMENTS

Figure 1:
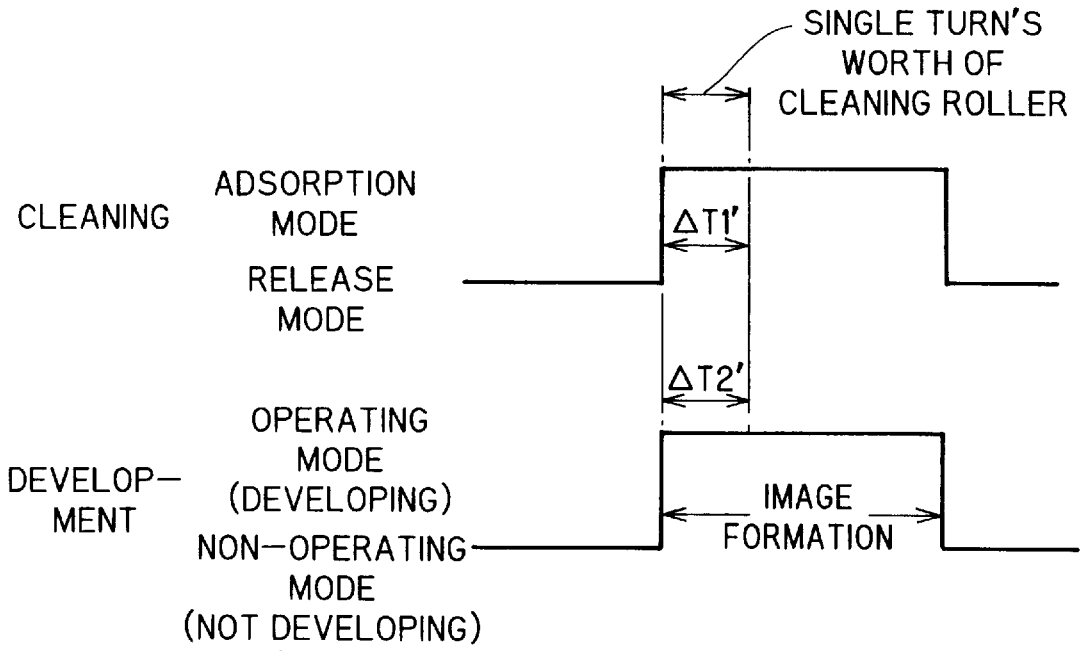
FIG. 1 is a timing chart representing, with a photosensitive drum as a standard, temporal relationship of cleaning and development operations in a conceivable image forming device.

An image forming device according to preferred embodiments of the present invention will be described while referring to the accompanying drawings wherein like parts and components are. designated by the same reference numerals to avoid duplicating description.

Figure 2:
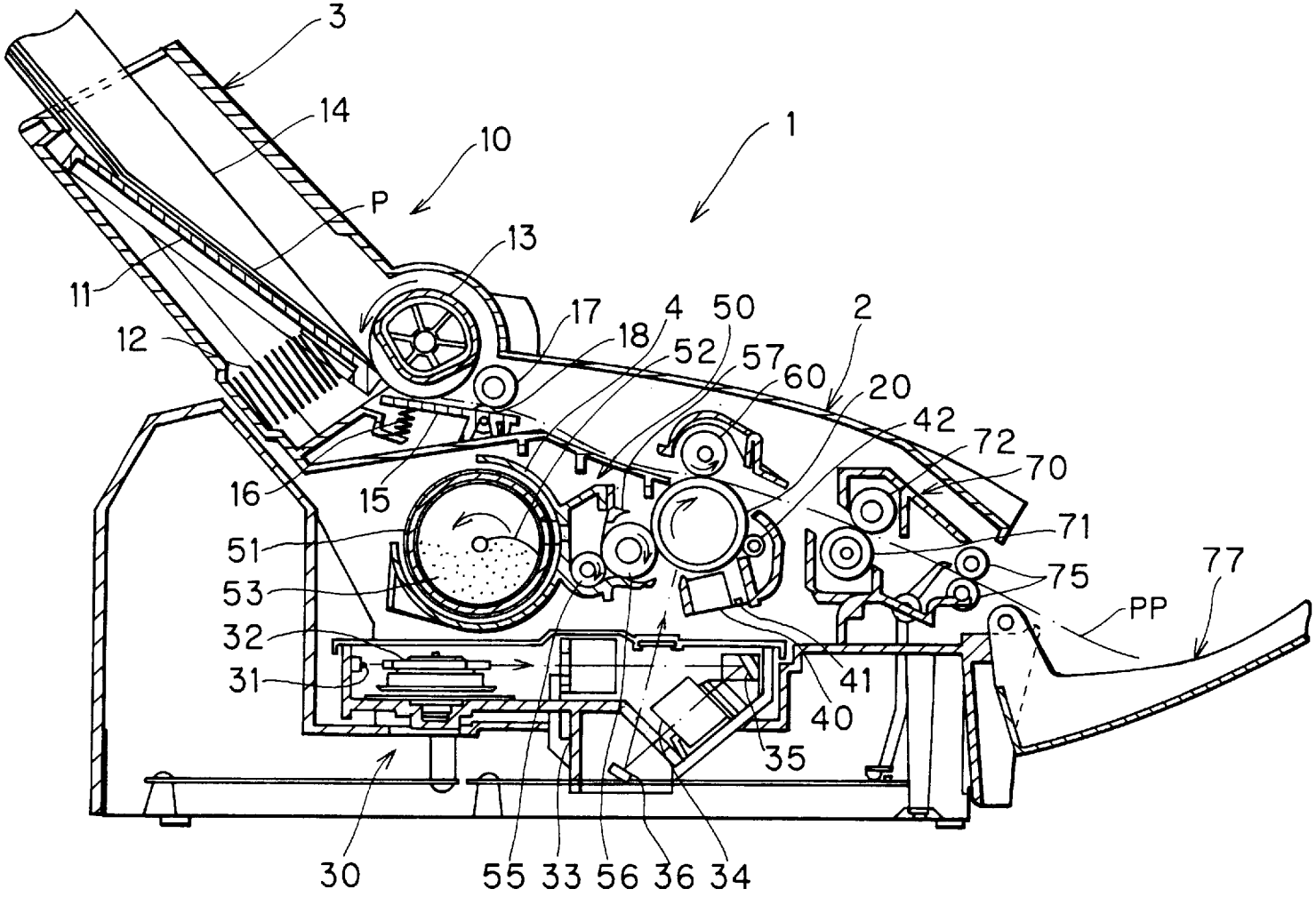
FIG. 2 is a cross-sectional view showing a laser printer according to a first embodiment of the present invention.

As shown in FIG. 2, a laser beam printer 1 according to the first embodiment includes: a main case 2; a feeder unit 10 for feeding sheets P which serve as an example of a recording medium to which images are formed; a photosensitive drum 20 on which charging, exposure, developing, transferring, recovering, and other operations are serially performed; a fixing unit 70 for fixing a toner image transferred from the photosensitive drum 20 onto the sheet P; and a discharge tray 77 onto which a sheet P fixed with a toner image is discharged after passing through a transport pathway PP.

Next, a detailed explanation will be provided for various components configuring the laser beam printer 1 while referring FIGS. 2 to 5, As shown in FIG. 2, the feeder unit 10 includes a feeder portion case 3 disposed at a rear portion of the main case 2. A sheet-supply case 14 is freely detachably mounted at a slanting angle within the feeder portion case 3. The sheet-supply cassette 14 is capable of housing a number of sheets P, which are cut to a predetermined shape.

A sheet pressing plate 11 is pivotably disposed about a shaft at the rear end portion of the feeder portion case 3. The sheet pressing plate 11 is formed with a width dimension substantially the same as the width of a sheet P. A compression spring 12 for urging the sheet pressing plate 11 upward against the sheets P in the sheet-supply cassette 14 is disposed at the front end portion of the sheet pressing plate 11.

A sheet-feed roller 13 is freely rotatably fixed adjacent to the sheet pressing plate 11. The sheet-feed roller 13 extends in the direction perpendicular to the sheet surface of FIG. 2. A separation member 15 is provided below the sheet-feed roller 13. The separation member 15 is for preventing redundant feed of sheet P, that is, two or more sheets at the same time. A compression spring 16 is provided for resiliently urging the separation member 15 toward the sheet-feed roller 13.

A drive system (not shown in the drawings) is provided for driving rotation of the sheet-feed roller 13 at a predetermined timing so as to feed one sheet P at a time from the sheets P housed in the sheet-supply cassette 14. A drive mechanism is also provided for rotating the photosensitive drum 20.

A pair of resist rollers 16, 17 rotatably provided downstream in a transport direction, that is, from left to right as viewed in FIG. 2, from the sheet-feed roller 13. The resist rollers 17, 18 align the front edge of supplied sheets P.

Several components are disposed around the periphery of the photosensitive drum 20. These include, in the clockwise direction as viewed in FIG. 2, a cleaning roller 42 that, at a predetermined timing to be described later, temporarily adsorbs residual toner remaining on the surface of the photosensitive drum 20 after transfer operations using the transfer roller 60 and that releases the residual toner back to the developing unit 50; a charge removing lamp 41 for removing residual electric potential remaining on the photosensitive drum 20 after completion of the transfer operations; a charge unit 40 for forming a uniform charge on the surface of the photosensitive drum 10; a laser scanner unit 30 for selectively irradiating the surface of the photosensitive drum 10 with laser light L to form electrostatic latent images on the surface of the rotating photosensitive drum 20; a developing unit 50 including a developing roller 56, which uses toner to develop electrostatic latent images on the surface of the photosensitive drum 20; and a transfer roller 60 that transfers the developed toner image from the surface of the photosensitive drum 20 onto a sheet P.

Figure 3:
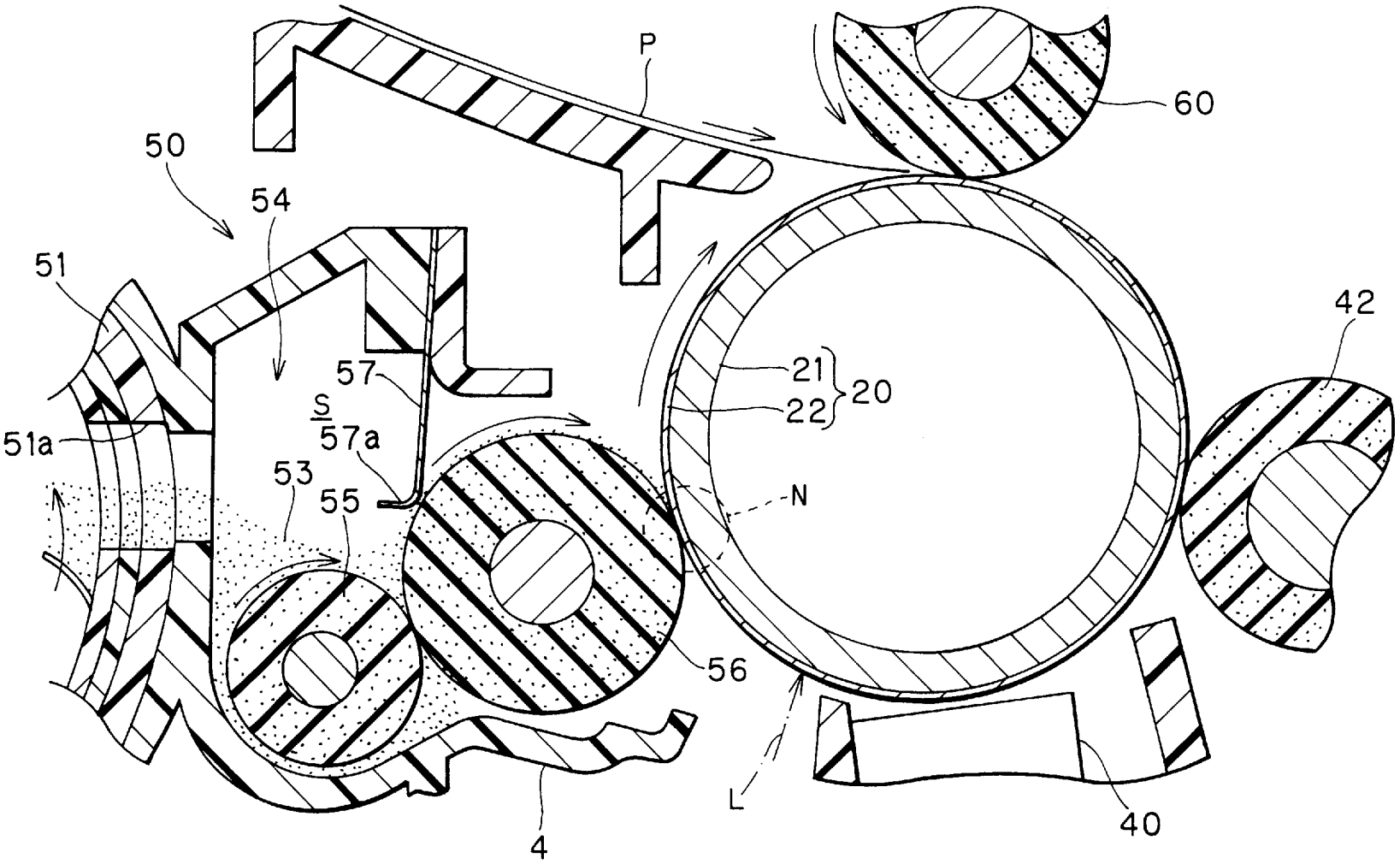
FIG. 3 is a cross-sectional view showing detail of a developing unit and a photosensitive drum of the laser printer in FIG. 2.

The photosensitive drum 20 is formed from a positively charged material such as an organic photosensitive body whose main component is positively charged polycarbonate. As shown in FIG. 3, the photosensitive drum 20 according to the present embodiment is formed in a hollow-shaped drum and includes: a hollow aluminum cylindrical sleeve 21; and an approximately 20 $\mu$m thick photoconductive layer 22 formed from polycarbonate through which is dispersed a photoconductive resin. The photosensitive drum 20 is freely rotatably disposed on the main case 2 and driven by a drive mechanism, not shown in the drawings, to rotate in the clockwise direction as viewed in FIGS. 2 and 3. The cylindrical sleeve 21 is in a grounded condition. With this configuration, electrostatic latent images formed on the surface of the photosensitive drum 20 are developed using reversal development techniques, wherein the electrostatic latent images are imparted with a positive polarity and developed using positively charged toner 53. Although the photosensitive drum 20 is connected to ground in the present embodiment, the photosensitive drum 20 can be connected to a voltage source for applying an appropriate large offset voltage.

The charge removing lamp 41 is provided with a light source such as a laser emitting diode (LED), an electro luminescence (EL), or a fluorescent light. The charge removing lamp 41 is adapted for removing residual charge remaining on the photosensitive drum 20 after transfer operations. In this way, the charge removing lamp 41 prevents residual charge from affecting subsequently formed electrostatic latent images so as to avoid degradation of resultant output image formed on the sheet P.

The charge unit 40 can be formed from a scorotoron type charge unit for positively charging the surface of the photosensitive drum 20 by generating corona discharge from a charge wire, such as a tungsten wire. Because the cleanerless method is used in the device of the present embodiment, the charge unit 40 is held in confrontation with, but out of contact from, the photosensitive drum 20 so that residual toner on the surface of the photosensitive drum 20 will not cling to the charge unit 40.

The laser scanner unit 30 is disposed beneath, that is, as viewed in FIG. 2, the photosensitive drum 20 and includes: a laser emitting device 31 for generating laser light L for forming electrostatic latent images on the surface of the photosensitive drum 20; a polygon mirror 32 driven to rotate; a pair of lenses 33, 34; and a pair of reflection mirrors 35, 36. The polygon mirror 32 is a five-sided mirror in the present embodiment.

As shown in FIGS. 2 and 3, the developing unit 50 includes: a double cylinder shaped toner box 51 detachably mounted within the developing portion case 4; a toner accumulation chamber 54 adjacent to the toner box 51; a supply roller 55 in the toner accumulation chamber 54; and the developing roller 56 disposed between and in contact with the supply roller 55 and the photosensitive drum 20.

The toner box 51 is filled with positively charged toner 53 having electrical insulating properties. The toner 53 of the present embodiment is imparted with a positive charge. The toner 53 is non-magnetic component toner formed from polymerized material such as styrene acryl, which may be a pulverized toner or a spherical shaped toner. The toner 53 includes a base toner and an additive such as silica added to the base toner. Silica is used as an additive for imparting the resultant toner with fluidity. Most of the toner 53 is imparted with positive polarity by friction such as between the developing roller 56 and the photosensitive drum 20. However, a minute amount of the toner 53 will be imparted with negative polarity. This negatively charged toner 53 will be referred to as opposite polarity toner hereinafter. An agitator 52 driven to rotate is provided in the toner box 51 to agitate the toner 53 and keep it from clumping together. A toner supply port 51*a* is formed in the toner box 51.

The toner accumulation chamber 54 is connected to the front side of the toner box 51 via the toner supply port 51*a*. Rotation of the agitator 52 supplies toner 53 through the toner supply port 51*a* into the toner accumulation chamber 54. As shown in FIG. 3, a large space S is provided in the toner accumulation chamber 54 above the supply roller 55.

The supply roller 55 is rotatably disposed in the toner accumulation chamber 54 so as to extend in a direction perpendicular to the surface of sheet of FIG. 3, that is, in a horizontal direction. The supply roller 55 is formed from an expendable resilient plastic foam, such as a urethane rubber or a silicone rubber, and has electric conductive properties. The contact portion between the supply roller 55 and the developing roller 56 is set with a resistance value of about $5\times10^4$ to $1\times10^9$ Ω.

The developing roller 56 is rotatably provided adjacent to the toner accumulation chamber 54 so as to partition off the toner accumulation chamber 54. The developing roller 56 is disposed so as to extend in parallel and in contact with both the supply roller 55 and the photosensitive drum 20. A nip portion N develops at the development position where the photosensitive drum 20 contacts the developing roller 56 as shown in FIG. 3.

The developing roller 56 is a rigid roller formed from a material having electrical conductive properties such as a urethane rubber or a silicone rubber. In the present embodiment, the developing roller 56 is formed form urethane rubber because the photosensitive drum 20 is formed from an organic photosensitive material whose main component is positively charged polycarbonate and because the toner is positively charged.

The developing roller 56 is applied with a developing bias voltage from its central electrode to the nip portion N at its periphery. The resistance value from the central electrode of the developing roller 56 to the nip portion N is set to about $5\times10^4$ to $1\times10^7$ Ω. A drive mechanism is provided for driving both the supply roller 55 and the developing roller 56 to rotate in the clockwise direction as viewed in FIG. 3.

The transfer roller 60 is freely rotatably supported in contact with the upper side of the photosensitive drum 20. The transfer roller 60 is formed from a material, such as silicone rubber or urethane rubber, expanded into a resilient plastic foam having electrical conductive properties. The contact portion between the transfer roller 60 and the photosensitive drum 20 is set to have a resistance value of about $5\times10^6$ to $1\times10^{10}$ Ω.

As shown in FIG. 3, a layer regulating blade 57 is provided depending from the developing portion case 4. The layer regulating blade 57 is formed into a resilient thin plate shape from stainless steel or phosphor bronze. The lower tip of the layer regulating blade 57 is formed into an angle portion 57*a*, which is in pressing contact with the surface of the developing roller 56. The angle portion 57*a* regulates, to a predetermined thickness of 7 to 12 μm, toner 53 which was supplied by the supply roller 55 and which clings on the surface of the developing roller 56.

The fixing unit 70 is provided downstream from the photosensitive. drum 20 with respect to the sheet transport direction. The fixing unit 70 includes: a heat roller 71 housing therein a conventional halogen lamp; and a pressing roller 72. A sheet P with a toner image transferred onto its lower surface is heated and pressed between the heat roller 71 and the pressing roller 72 so that the toner image is fixed on the sheet P.

A pair of transport rollers 75 and the discharge tray 77 are provided downstream in the sheet transport direction from the fixing unit 70. Because, as shown in FIG. 2, the sheet transport pathway PP extends in a substantially linear shape from the sheet-supply roller 13, the photosensitive drum 20, the fixing unit 70, and the discharge tray 77, the laser printer can perform image formation on sheets P having a variety of different thicknesses.

The cleaning roller 42 is formed from an expended resilient material, such as silicone rubber or urethane rubber. The material must have electrical conductive properties and be capable of being applied with various voltages. Although in the present embodiment the cleaning roller 42 is provided to recover residual toner 53 from the developing roller 56, a cleaning brush for leveling residual toner 53 on the surface of the photosensitive drum 20 could be provided instead of, or in addition to, the cleaning roller 42.

As mentioned above, the cleaning roller 42 has an adsorption mode and a release mode. While the cleaner roller 42 is in its adsorption mode, the bias voltage of the cleaning roller 42 is changed so that the residual toner 53, that is, toner that remains on the photosensitive drum 20 due to non-transfer to the sheet P when the sheet P is moved pass the roller 60, is temporarily adsorbed on the surface of the cleaning roller 42. When the cleaning roller 42 is in its release mode, the temporarily adsorbed toner 53 is released from the cleaning roller 42 toward the photosensitive drum 20 by again changing the bias voltage of the cleaning roller 42 at an appropriate timing at which subsequent exposure, development, and transfer operations will not be adversely influenced by the released toner. Then, the residual toner 53 on the photosensitive drum 20 is collected by the developing roller 56 and recycled back to the developing unit 50.

An explanation of an example electrical configuration for performing this process will be described while referring to FIG. 5. Two power sources are provided for applying voltage to the cleaning roller 42: a first power source 101 for supplying release voltage Vc; and a second power source 102 for supplying adsorption voltage Vs. A switch SW1 is provided for selectively connecting the cleaning roller 42 to the first power source 101 and the second power source 102. A controller 105 such as a microcomputer is provided for controlling the switching operation of the switch SW1. A detection unit 106 is provided in connection with the controller 105. The detection unit 106 detects timing at which image formation processes are to be performed and outputs a detection signal Sd accordingly.

In the adsorption mode, the controller 105 controls the switch SW1 to connect the cleaning roller 42 to the second power source 102 so that an adsorption electric potential Vs develops at the cleaning roller 42. On the other hand, in the release mode, the controller 105 controls the switch SW1 to connect the cleaning roller 42 to the first power source 101 so that a release electric potential Vc develops at the cleaning roller 42.

Next, timing at which the controller 105 controls the switch SW1 will be explained. For this explanation and hereinafter, a portion of the photosensitive drum 20 on which images are to be formed and then transferred to a sheet P will be referred to as an image forming region of the photosensitive drum 20. Also, the position where the cleaning roller 42 contacts the photosensitive drum 20 will be referred to as the leveling position hereinafter. Further, a predetermined distance equal to at least the peripheral width of the cleaning roller 42 will be referred to alternatively as at least a single turn's worth of the cleaning roller 42, hereinafter. At least a single turn's worth of the cleaning roller 42 includes all integral distances equivalent to multiples of the peripheral width of the cleaning roller 42 such as one full turn, two full turns, three full turns, and the like.

So that opposite polarity toner 53 released during the adsorption mode of the cleaning roller 42 will not degrade images to be formed on the photosensitive drum 20, when an image forming region of the photosensitive drum 20 is as at least a single turn's worth of the cleaning roller 42 before the leveling portion, then the controller 105 controls the switch SW1 to switch the cleaning roller 42 into its adsorption mode. When a cleaning brush is provided instead of, or in addition to, the cleaning brush, the timing of the adsorption mode and the release mode should be set so that dimension of the cleaning brush in the rotational direction of the photosensitive drum 20 corresponds to the single turn's worth of the cleaning roller 42.

The controller 105 calculates timing at which an image forming region of the photosensitive drum 20 will reach the leveling position based on the detection signal Sd outputted from the detection unit 106 and on the rotational condition of the photosensitive drum 20. The detection unit 105 can detect the timing at which image formation processes are to be performed using a variety of methods. For example, the detection unit, 106 can detect timing at which sheets P are transported near the resist rollers along the transport pathway PP. As an alternative method, the detection unit 106 can detect image formation timing of the laser scanner unit 30. The controller 105 then calculates appropriate timing based on a detection signal Sd from the detection unit 106 at this timing and on the rotational condition of the photosensitive drum 20.

When the cleaning roller 42 is switched to its adsorption mode at such a predetermined timing, opposite polarity toner 53 clinging to the cleaning roller 42 is released from around the entire periphery of the cleaning roller 42 from the time when the cleaning roller 42 switches to its adsorption mode until the image forming region of the photosensitive drum 20 reaches the leveling position. As a result, by the time the image forming region of the photosensitive drum 20 reaches the leveling portion, the cleaning roller 42 will have released most of the opposite polarity toner 53 adhering thereto and so will be unable to release further opposite polarity toner 53 during the adsorption mode.

As a result, high quality images can be formed without fear of image quality being reduced by presence of opposite polarity toner 53 on the surface of the photosensitive drum 20. The opposite polarity toner 53 remaining on the cleaning roller 42 can be prevented from adversely affecting on image formation. Further, the opposite polarity toner 53 is recycled back to the developing roller 56 by switching the cleaning roller 42 between its release mode and its adsorption mode at timing based on units equivalent to single complete turns of the cleaning roller 42. Therefore, the opposite polarity toner 53 can be recycled back to the developing roller 56 using a relatively simple configuration.

Figure 4:
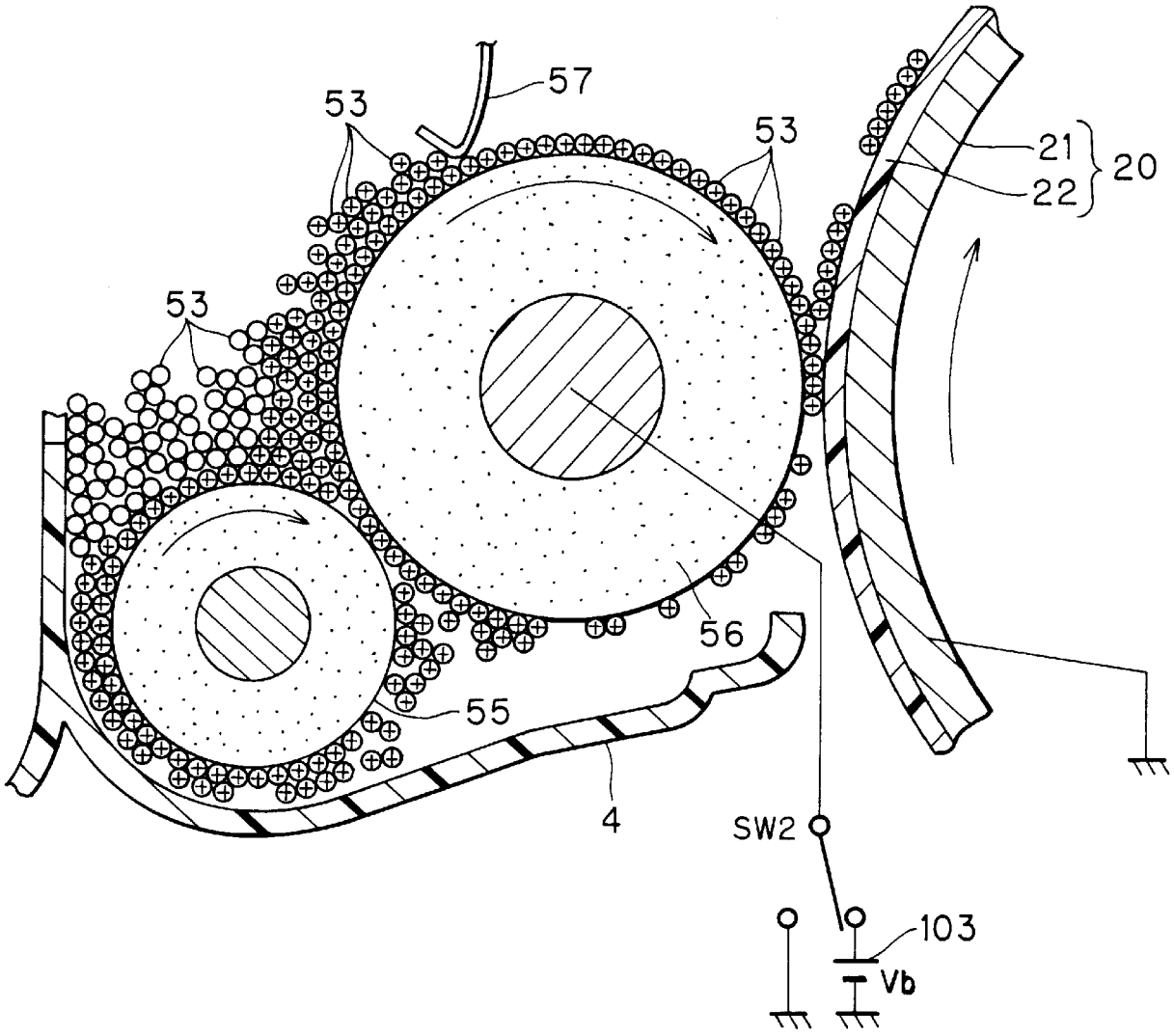
FIG. 4 is a cross-sectional view showing further detail of the developing unit in FIG. 3.
Figure 5:
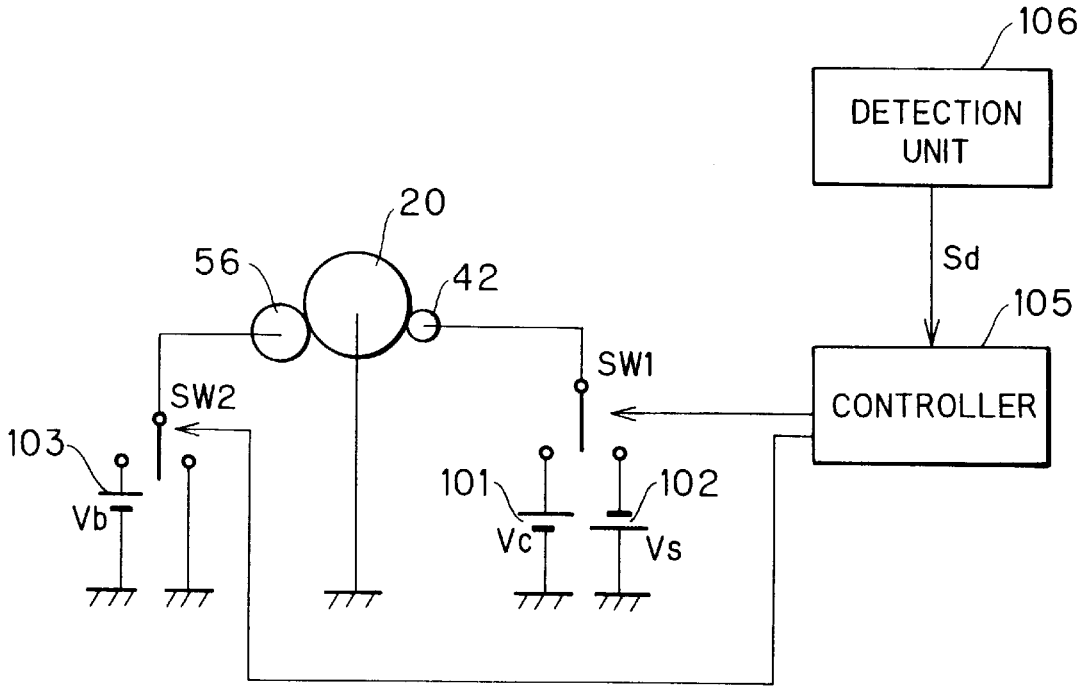
FIG. 5 is a circuit diagram schematically showing electrical connection between various switches, power sources, and components of the laser printer.

As shown in FIGS. 4 and 5, a third power source 103 is provided for supplying the developing roller 56 with a developing voltage Vb. A switch SW2 is provided for selectively connecting the developing roller 56 to the third power source 103 and to ground. The controller 105 controls the switch SW2 to switch the developing roller 56 between an operating mode, wherein the developing roller 56 is connected to the third power source 103 and applied with the developing voltage Vb, and a non-operating mode, wherein the developing roller 56 is connected to ground.

When the developing roller 56 is placed in its operating condition by application of the developing voltage Vb via the switch SW2, the electrostatic latent image on the photosensitive drum 20 is developed using positively charged toner 53. When the developing roller 56 is placed into its non-operating condition by being connected with ground via the switch SW2, then residual toner 53 returned to the photosensitive drum 20 by the cleaning roller 42 is recovered.

Until the electrostatic latent image formed on the photosensitive drum 20 reaches the developing position, that is, the position where the developing roller 56 contacts the photosensitive drum 20, the controller 105 controls the switch SW2 to put the developing roller 56 in its non-operating condition. While the developing roller 56 is in its non-operating condition, it recovers the opposite polarity toner 53, which was released from around the entire periphery of the cleaning roller 42 during adsorption mode of the cleaning roller 42, and the positively charged toner 53, which was released from the cleaning roller 42 to the photosensitive drum 20 during the release mode of the cleaning roller 42.

Next, operations of the laser beam printer 1 will be explained while referring to FIGS. 2 to 7. First, the photosensitive drum 20, the supply roller 55, and the developing roller 56 are driven by the drive mechanism to rotate in the clockwise direction as viewed in FIG. 2. As a result, most of the toner 53 is imparted with positive polarity charge by pressure friction between the supply roller 55 and the developing roller 56 and between the layer regulating blade 57 and the developing roller 56. The toner 53 imparted with positive charge in this manner is further charged by friction between the developing roller 56 and the photosensitive drum 20. As shown in FIG. 4, the toner 53 clings to and develops the electrostatic latent image formed on the surface of the photosensitive drum 20 by laser beam L. Minute quantities of opposite polarity toner also clings to the surface of the photosensitive drum 20 by Van der Waals forces.

The charge of the toner 53 varies from about 25$\mu$ C/g to 10$\mu$ C/g, depending to the ambient temperature and humidity. When the developing roller 56 is driven to rotate in the same direction as the photosensitive drum 20, regardless of whether the ambient environment is low temperature and low humidity or high temperature and high humidity, the effective developing bias voltage of the developing roller 56, that is, the electric potential difference between the electric potential of the electrostatic latent image of the photosensitive drum 20 and the electric potential of the developing roller 56, should be set to 200 volts to insure that the electrostatic latent image is developed by a predetermined amount of developing toner of about 0.78 mg/cm$^2$.

Figure 6:
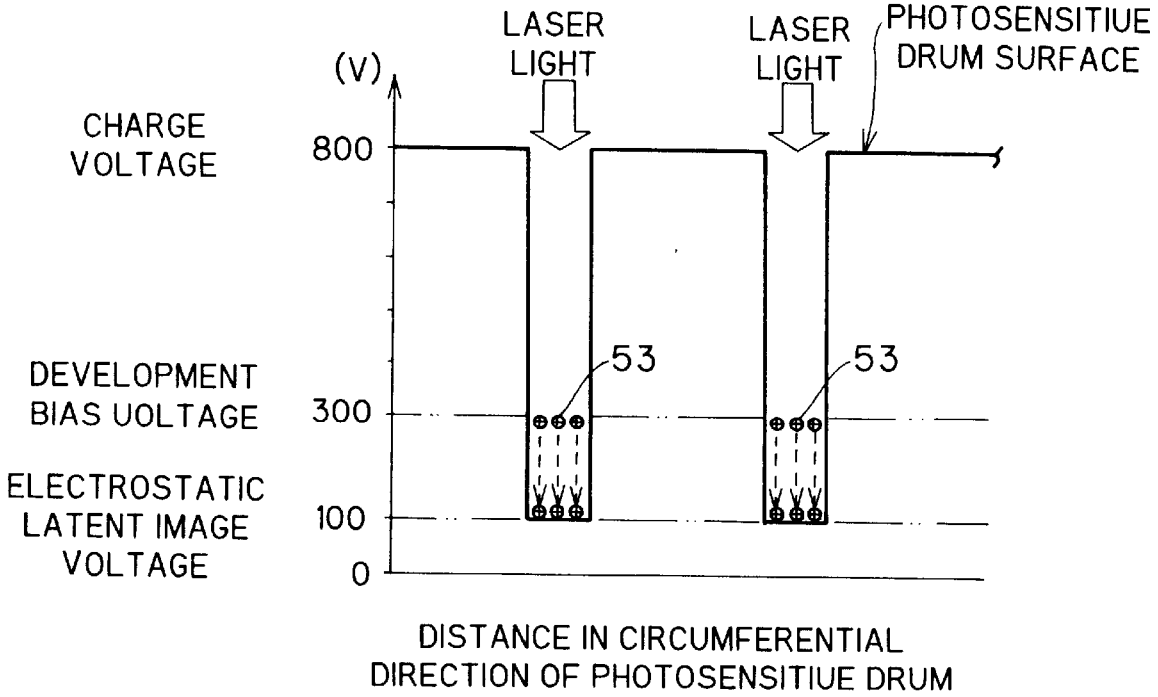
FIG. 6 is a graphical representation of change in electric potentials of various components during development processes of the laser printer.

A developing toner amount of 0.78 mg/cm$^2$ is considered an amount sufficient for providing proper image density. For example, as shown in FIG. 6, when the grounded photosensitive drum 20 imparted with a charge of about 800 volts by the charge unit 40 and the electrostatic latent image formed on the surface of the photosensitive drum 20 has a voltage of about 100 volts, then the voltage Vb applied by the third power source 103 to the developing roller 56 should be set to about 300 volts to obtain an effective developing bias voltage of about 200 volts.

The voltage Vs applied by the second power source 102 to the cleaning roller 42 is set to about 250 volts, which would obtain an electric potential of negative 300 volts at the electrostatic latent image, so that residual toner 53 imparted with a positive polarity and remaining on the photosensitive drum 20 after decharging operations will be adsorbed to the cleaning roller 42. Further, the voltage Vc applied from the first power source 101 to the cleaning roller 42 is set to about 450 volts, which would result in an electrical potential of positive 350 volts at the electrostatic latent image, so that after decharging operations residual toner 53 will be released from the surface of the cleaning roller 42 back to the surface of the photosensitive drum 20.

By setting various voltages in the manner described above, when the switch SW1 connects the cleaning roller 42 to the second power source 102 while the cleaning roller 42 is in its adsorption mode, an electrical potential difference– of 350 V develops between the electrostatic latent image on the photosensitive drum 20 and the cleaning roller 42 so that positively charged toner 53 clinging to the photosensitive drum 20 after decharging operations is adsorbed on the surface of the cleaning roller 42.

On the other hand, when the switch SW1 connects the cleaning roller 42 to the first power source 101 while the cleaning roller 42 is in its release mode, an electrical potential difference of +350 V develops between the electrostatic latent image on the photosensitive drum 20 and the cleaning roller 42 so that the residual toner 53 is released from the cleaning roller 42 back to the surface of the photosensitive drum 20.

However, because the opposite polarity toner 53 is charged with an opposite polarity, as described above, the opposite polarity toner 53 clinging to the surface of the photosensitive drum 20 is adsorbed to the cleaning roller 42 during the release mode and is released from the surface of the cleaning roller 42 during the adsorption mode.

At a start of image forming processes, first, all residual charge is removed from the surface of the photosensitive drum 20 by the charge removing lamp 41. Next, as shown in FIG. 6, the charge unit 40 imparts a uniform charge of 800 V across the surface of the photosensitive drum 20. Laser light L emitted from the laser emission unit 31 is scanned in a main scanning direction by the polygon mirror 32, transmitted through the lenses 33, 34, and reflected by the reflection mirrors 35, 36 toward the photosensitive drum 20. Portions of the photosensitive drum 20 irradiated by the laser light L are formed with an electrostatic latent image. Portions on the surface of the photosensitive drum 20 irradiated with the laser light L are formed with an electrostatic latent image having voltage of 100 V. When developing bias voltage of 300 V is applied to the surface of the developing roller 56, then toner 53 will be drawn toward the lower voltage of 100 V at the electrostatic latent image and will not be attracted to higher charge voltage of 800 V at other portions of the photosensitive drum 20. Therefore, the toner 53 from the developing roller 56 will cling to and develop the electrostatic latent image formed on the surface of the photosensitive drum 20.

The toner image formed by developing the electrostatic latent image using toner 53 is then transferred via the transfer roller 60 onto a sheet P. Then, the toner 53 is fixed on the sheet P using the fixing unit 70 and the sheet P is discharged onto the discharge tray 77.

Because the transport pathway PP from the sheet-feed cassette 14 to the discharge tray 77 is formed in a substantially linear shape, images will be formed on the sheet P while the sheet P is transported along a substantially linear shaped transport pathway PP. As a result, images can be reliably and clearly formed on the sheet P regardless of whether the sheet P is a thick sheet, such as a postcard or an envelope, or a thin sheet, such as an overhead projective film.

When the switch SW1 connects the cleaning roller 42 to the second power source 102, thereby putting the cleaning roller 42 into its adsorption mode so that an electrical potential difference −350 V is developed between the cleaning roller 42 and the surface of the photosensitive drum 20, the toner 53 remaining on the photosensitive drum 20, that is, the toner 53 not transferred to a sheet P passing the transfer roller 60, is temporarily adsorbed on the cleaning roller 42. Next, at a timing which will not adversary affect exposure, developing, and transfer operations performed on the surface of the photosensitive drum 20, the switch SW1 is controlled to connect the cleaning roller 42 to the first power source 101, thereby putting the cleaning roller 42 into its release mode so that an electrical potential difference of +350 V will develop between the cleaning roller 42 and the surface of the photosensitive drum 20. As a result, residual toner 53 temporarily adsorbed on the cleaning roller 42 will be released so as to impinge on the surface of the photosensitive drum 20.

When the residual toner 53 is returned to the developing roller 56 by rotation of the photosensitive drum 20, the switch SW2 is controlled to reconnect the developing roller 56 to ground so that the developing roller 56 is brought into its non-operating condition, whereupon the residual toner 53 on the surface of the photosensitive drum 20 can be recovered by the developing roller 56.

Toner 53 can be recovered in this manner by periodically stopping image forming operations and then placing the cleaning roller 42 into its release mode or can be performed between supply of different sheets so that image forming operations will not be interfered with.

Figure 7:
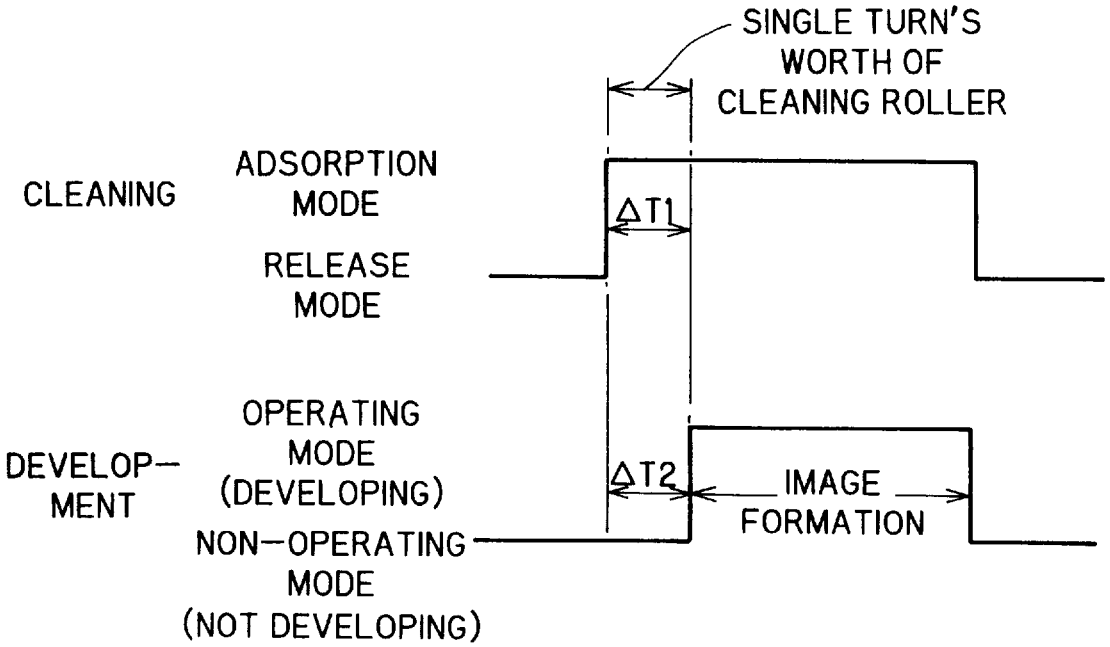
FIG. 7 is a timing chart representing, with the photosensitive drum as a standard, temporal relationship of cleaning and development operations in the laser printer of the first embodiment

FIG. 7 is a timing chart showing temporal relationship between modes of the cleaning roller 42 and the operating condition of the developing roller 56. It should be noted that the timing chart uses the photosensitive drum 20 as its standard to facilitate understanding. As shown in FIG. 7, when the image forming region of the photosensitive drum 20 is the predetermined distance, which is equal to at least a single turn's worth of the cleaning roller 42, before the leveling position, the controller 105 controls the switch SW1 to switch the cleaning roller 42 into its adsorption mode. Accordingly, during the corresponding time duration Δ T1, opposite polarity toner 53 clinging to the cleaning roller 42 is released during the single turn's worth of the cleaning roller 42 during the adsorption mode.

During a corresponding time duration Δ T2, the controller 105 controls the switch SW2 to maintain the developing roller 56 in its non-operating condition so that no image will be formed on the photosensitive drum 20 where opposite polarity toner exists. The opposite polarity toner 53 transferred from the cleaning roller 42 to the surface of the photosensitive drum 20 is recovered by the developing roller 56 during the time duration Δ T2 when the developing roller 56 is in non-operating condition.

As the photosensitive drum 20 rotates, the image forming region of the photosensitive drum 20 reaches a position where it is irradiated by laser light L from the laser scanner unit 30 and imparted with an electrostatic latent image. Further rotation of the photosensitive drum 20 brings the electrostatic latent image to the developing position, whereupon the controller 105 controls the third switch SW2 to switch the developing roller 56 into its operating mode so that the electrostatic latent image on the surface of the photosensitive drum 20 is developed with toner 53.

Toner 53 charged with a predetermined polarity and accumulated on the cleaning roller 42 is released onto the photosensitive drum 20 during the release mode of the cleaning roller 42 before the cleaning roller 42 is switched to its adsorption mode. Further, the toner 53 is recovered by the developing roller 56 while it is in its non-operating condition. Therefore, poor image quality, caused by great amounts of opposite polarity toner being released from the cleaning roller 42 during its first turn after being switched to its adsorption mode, which amounts to the release mode for opposite polarity toner, can be avoided.

While portions of the photosensitive drum 20 to which most of the opposite polarity toner released from the cleaning roller adsorbs passes by the developing position, the developing roller is placed into its non-operating condition so that opposite polarity toner can be recovered. In this way, image quality will not suffer from existence of opposite polarity toner on the surface of the photosensitive drum.

Next, an image forming device according to a second embodiment of the present invention will be described. The configuration of the image forming device according to the second embodiment is substantially the same as that of the image forming device described in the first embodiment. However, according to the second embodiment, the detection unit 106 detects a predetermined condition of the laser beam printer 1, such as, that a paper jam has been corrected, that operations of the laser beam printer 1 have been stopped for long period of time, or that the power supply of the laser beam printer 1 has been turned on. When the detection unit 106 detects such a predetermined condition, then it outputs its detection signal Sd to the controller 105. When the controller 105. receives the detection signal Sd, it controls the switch SW1 to switch the cleaning roller 42 into its release mode for a single turn's worth of the cleaning roller 42. As a result, the cleaning roller 42 will release positively charged toner 53 accumulated thereon. Then, the controller 105 controls the switch SW1 to place the cleaning roller 42 into its adsorption mode for a single turn's worth of the cleaning roller 42. As a result, the cleaning roller 42 will release opposite polarity toner 43 accumulated thereon. Accordingly, both positively charged and negatively charged toner 53 will be released from the outer periphery of the cleaning roller 42. Therefore, toner 53 accumulated on the cleaning roller, 42 during the predetermined condition will be sufficiently released from the cleaning roller 42 so that the cleaning function of the cleaning roller 42 will not be reduced by accumulation of toner 53.

While the toner-covered portion of the photosensitive drum 20, that is, the portion corresponding to the single or more turn's worth of the cleaning roller 42 during the release mode and to the single or more turn's worth of the cleaning roller 42 during the adsorption mode, passes the development position, indicated as the nip portion N in FIG. 3 where the photosensitive drum 20 contacts the developing roller 53, then the controller 105 controls the switch SW1 to place the developing roller 56 into its non-operating condition. As a result, positively charged toner 53 released from the cleaning roller 42 onto the photosensitive drum 20 during the release mode of the cleaning roller 42 and the opposite polarity toner 53 released during the adsorption mode will be recovered by the developing roller 56 being in its non-operating condition.

It is desirable that, upon detection of the predetermined condition by the detection unit 106, the cleaning roller 42 be placed into its adsorption mode and its release mode two times or more each for a single turn's worth or greater distance each time. As a result, positively charged toner 53 will be released from the entire periphery of the cleaning roller 42 for two times or more. Also, the opposite polarity toner 53 will be released from around the entire periphery of the cleaning roller 42 for two turns or more. Therefore, toner 53 accumulated on the cleaning roller 42 during the predetermined condition will be sufficiently released from the cleaning roller 42 so that the cleaning function of the cleaning roller 42 will not be reduced by accumulated toner 53.

Figure 8:
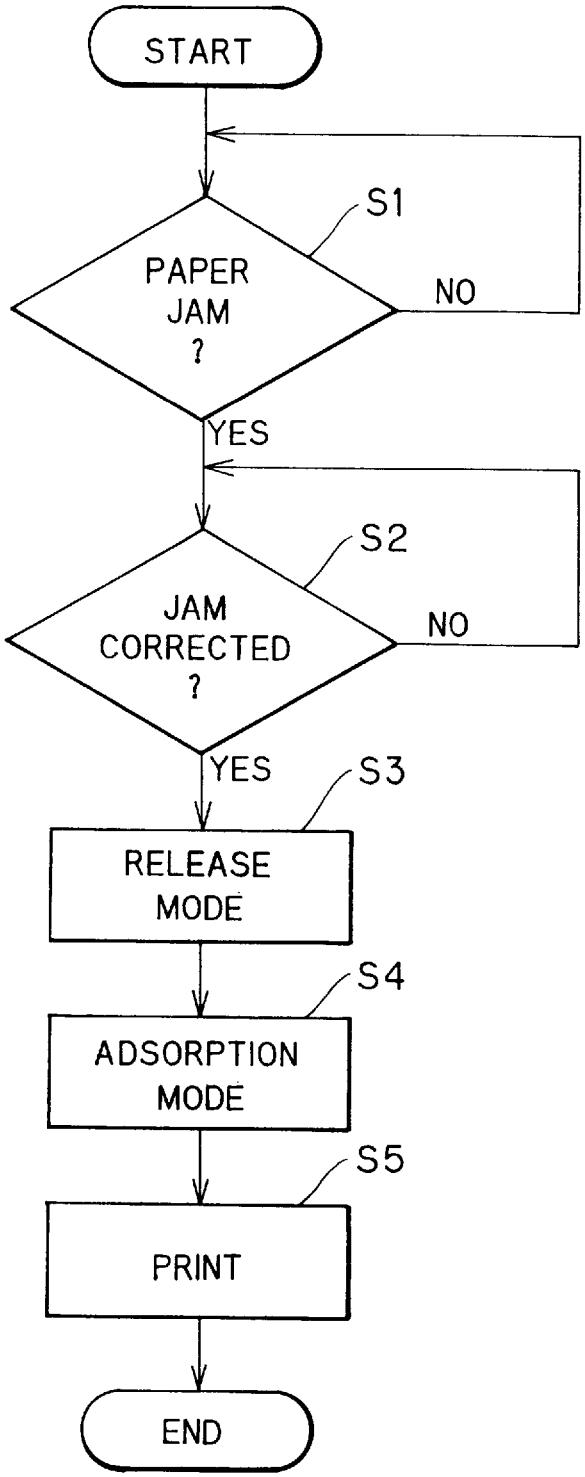
FIG. 8 is a flowchart representing operations performed when correction of a paper jam is detected in a laser printer according to a second embodiment of the present invention.

Next, several examples of cleaning processes performed by the present device when the predetermined condition is detected will be described while referring to the flowchart in FIGS. 8 to 10. First, an explanation will be provided while referring to FIG. 8 for cleaning processes performed when the detection unit 106 detects, as a predetermined condition, a correction of a paper jam occurring in the laser beam printer 1.

First, during normal operation of the laser beam printer 1, the controller 105 determines whether or not the detection unit 106 or another detection unit has detected a paper jam in S1. Detection of paper jams is well-known in the art so detailed description of this detection process will be omitted.

When the detection unit 106 or another detection unit 106 detects a paper jam (S1:YES), then the controller 105 determines whether or not the paper jam has been corrected in S2. Here also, correction of paper jams and its detection is well-known in the art so detailed description will be omitted.

During paper jams, toner 53 can excessively accumulate on the surface of the photosensitive drum 20 due to errors in transfer of the image from the photosensitive drum 20 to the sheet P. As a result, a great deal of toner 53 can become accumulated on the cleaning roller 42. Therefore, when the controller 105 determines that a paper jam has been corrected (S2:YES), then the controller 105 controls the switch SW1 to place the cleaning roller 42 into its release mode for at least a single turn's worth or greater in S3. As a result, positively charged toner 53 will be released onto the surface of the photosensitive drum 20.

Next, in S4, the controller 105 controls the switch SW1 to place the cleaning roller 42 into its adsorption mode for at least a single turn's worth or more. As a result, opposite polarity toner 53 is released onto the surface of the photosensitive drum 20. Therefore, after a paper jam is corrected, the cleaning roller 42 will in a condition to sufficiently adsorb toner 53 and will not release opposite polarity toner 53.

Next, print operations are started in S5. At this point, the image quality printed on the sheet P directly after correction of a paper jam will be a high quality.

Figure 9:
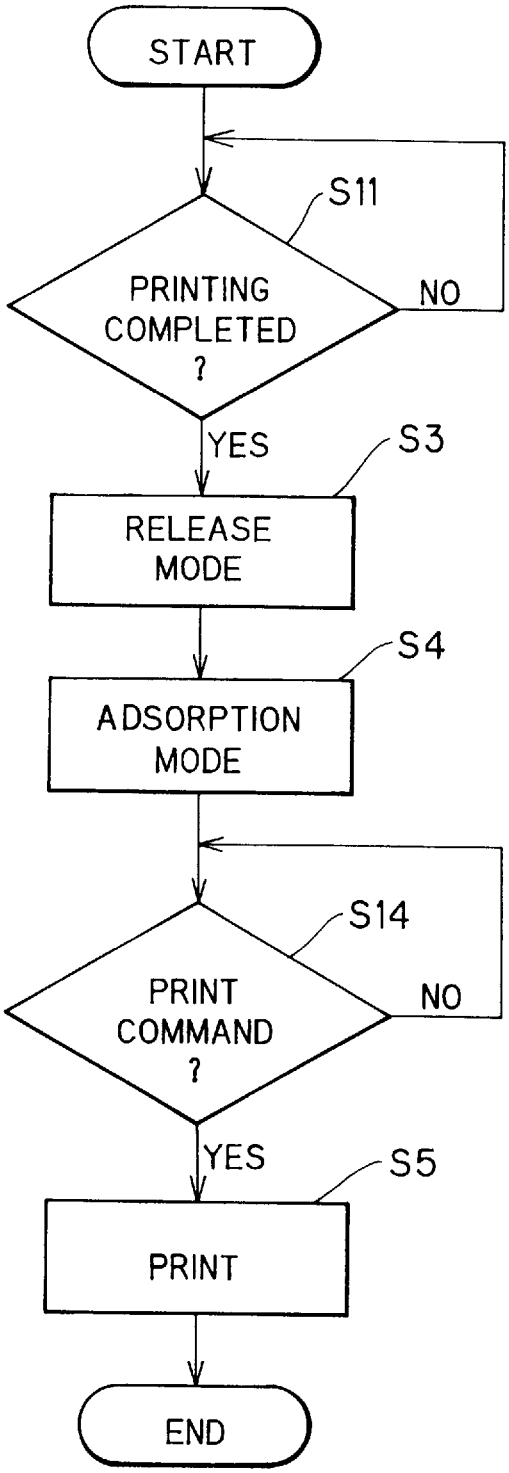
FIG. 9 is a flowchart representing operations performed when completion of printing operations is detected in the laser printer according to the second embodiment.

Next, an explanation will be provided while referring to FIG. 9 for cleaning processes performed when the detection unit 106 detects, as a predetermined condition, that operation of the laser beam printer 1 has been stopped for a long period of time. It should be noted that the same steps appearing in both flowcharts in FIGS. 8 and 9 are referred to with the same numbering.

First, in S11 the controller 105 uses the detection unit 106 to determine whether or not normal operations of the laser beam printer 1 printing operations have been completed. In this case, the detection unit 106 can detect whether or not printing operations have been completed by, for example, measuring a predetermined time duration such as one minute, five minutes, or ten minutes while awaiting input of a print start command. When the predetermined time elapses without input of the print start command, then the detection unit 106 detects that print operations have been completed.

Next, when the controller 105 detects that the print operations have been completed (S11:YES), then in S3, the cleaning roller 42 is put into its release mode for at least a single turn's worth or more so that positively charged toner 53 is released to the surface of the photosensitive drum 20. Next in S4, the cleaning roller 42 is put into its adsorption mode so that opposite polarity toner 53 is also released onto the surface of the photosensitive drum 20 for at a least single turn's worth or more. Next in S14, the controller 105 determines whether or not a print start command has been inputted. If so (S14:YES), then print operations are started in S5. At this time, because of the processes performed in S3 and S4, the cleaning roller 42 will be sufficiently capable of adsorbing toner 53 and will be in a condition where it will not release opposite polarity toner 53. Therefore, the printing operations of S5 are performed using a sufficiently clean photosensitive drum 20. After completion of the printing operations in S5, the program returns to its start and in S11 again determines whether or not printing operations have been completed. As a result, when image forming processes are again started, even though the images formed immediately on the first sheet P, image quality will not be reduced.

Figure 10:
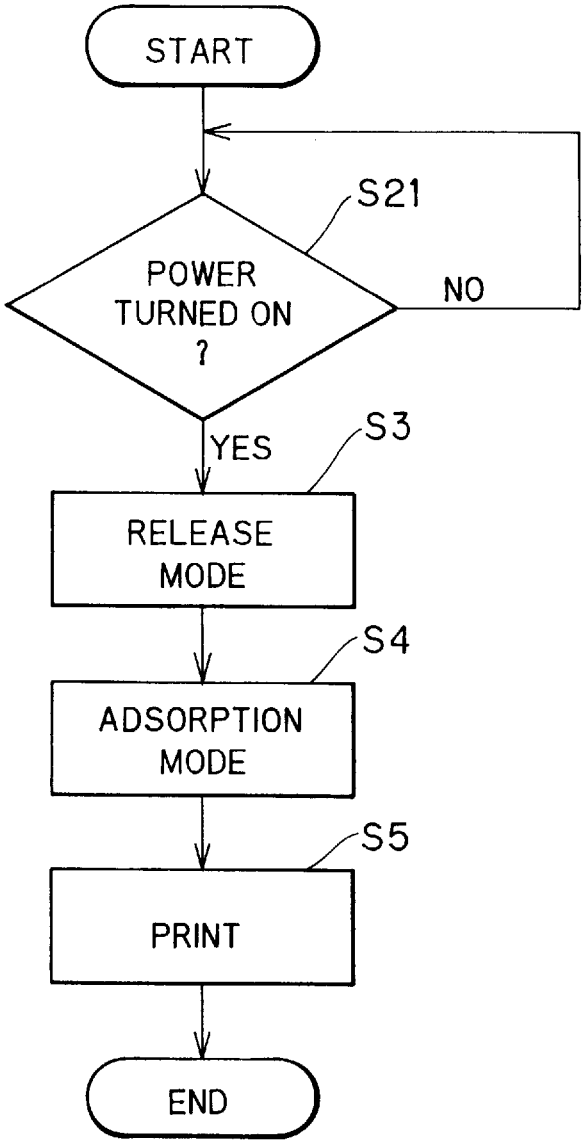
FIG. 10 is a flowchart representing operations performed when turning on of power is detected in the laser printer according to the second embodiment.

Next, an explanation will be provided while referring to FIG. 10 for cleaning roller 42 performed when the detection unit 106 detects, as a predetermined condition, that the power source of the laser beam printer 1 has been turned on. Steps in FIG. 10 including the same operations as steps in FIG. 8 will be indicated by the same numbering.

First, in S21 the controller 105 determines whether or not the power source of the laser beam printer 1 has been turned on. Detection of whether a power source has been turned on is well-known in the art, so a detailed explanation of this detection operation will be omitted. When the controller 105 determines that the power source has been turned on (S21:YES), then the cleaning roller 42 is put into its release mode for at least a single turn's worth or greater distance in S3 so that positively charged toner 53 is released onto the surface of the photosensitive drum 20. Next, the cleaning roller 42 is put into its adsorption mode or at least a single turn's worth in S4 so that opposite polarity toner 53 is released onto the surface of the photosensitive drum 20. As a result, after power has been initially turned on, the cleaning roller 42 will be sufficiently capable of adhering toner 53 and will be in a condition where it will not release opposite polarity toner 53.

Next in S5, printing operations are started. At this time, the image recorded on the first sheet P will be high quality even if the power was turned off while the cleaning roller 42 had adsorbed thereto a great deal of toner 53.

Therefore, with the laser beam printer 1 according to the second embodiment, performance of the cleaning roller 42 will not be reduced because it released insufficient amount of toner 53 not only during normal operations, but after paper jams, after the laser beam printer 1 has been stopped for a period of time, or after the power source is turned on. The image quality can be maintained at a high level. The laser beam printer 1 can be prevented from performing defective printing caused by residual toner 53 accumulating onto the photosensitive drum 20 because the performance of the cleaning roller 42 has been reduced.

Next, a device according to a third embodiment of the present invention will be described. When the lead portion of the image forming region reaches the leveling position where the cleaning roller 42 contacts the photosensitive drum 20, then the controller 105 controls the switch SW1 to switch the cleaning roller 42 into its adsorption mode. Next, when the end portion of the image forming region reaches the leveling unit, then the controller 105 controls the switch SW1 to switch the cleaning roller 42 into its release mode. Accordingly, during the inter-sheet interval, that is, from when the end portion of an image forming region passes by the leveling position until when the lead portion of a subsequent image forming region reaches the leveling position, then the cleaning roller 42 is in its release mode and therefore releases residual toner 53 therefrom onto the photosensitive drum 20.

The controller 105 calculates timing at which the lead portion of the image forming region will reach the leveling position based on the rotational condition of the photosensitive drum 20 and the detection signal Sd outputted from the detection unit 106. In this embodiment, the detection unit 106 detects the lead edge of the sheet P onto which the toner image formed in the image forming region is to be transferred. Said differently, the lead edge of the sheet P corresponds to the lead edge of the image forming region. The detection unit 106 includes a sensor provided near the resist rollers 17 in the transport pathway PP. The sensor mechanically or optically determines the lead portion of the sheet P. The sensor of the detection unit 106 outputs the detection signal Sd when the lead portion of the sheet P is detected. Alternatively, the controller 105 can be configured to calculate the lead portion of the image forming region using rotational condition of the photosensitive drum 20 at a predetermined timing after the image is formed using the laser scanner unit 30.

In the present embodiment, the cleaning roller 42 is made so that a single turn's worth thereof corresponds to equal to or less than the length of a non-image forming region of the photosensitive drum 20. The non-image forming region of the photosensitive drum 20 corresponds to the area of the photosensitive drum 20 between consecutively transported sheets P and extends in the rotational direction of the photosensitive drum 20 to a distance equivalent to the inter-sheet distance between consecutively transported sheets P. Accordingly, during one inter-sheet interval, toner accumulated on the cleaning roller 42 is released from around the entire periphery of the cleaning roller 42. As a result, almost all of the residual toner is released from the cleaning roller 42 in between transport of successive sheets.

Also, in the present embodiment, the cleaning roller 42 and the photosensitive drum 20 are driven by a drive unit so that their peripheral speeds are different. Because their peripheral speeds differ, the photosensitive drum 20 and the cleaning roller 42 scrape against each other at the leveling position where they contact each other. As a result, the cleaning roller 42 efficiently adsorbs residual toner 53 from the photosensitive drum 20 while in its adsorption mode. Further, the adsorbed residual toner 53 is efficiently released onto the photosensitive drum 20 while the cleaning roller 42 is in its release mode. It should be noted that in this case, the peripheral speed of either of the cleaning roller 42 or the photosensitive drum 20 can be set faster than the other.

With this configuration, toner from the cleaning roller 42 can be returned to the developing roller 56 by switching the cleaning roller 42 between its release mode and its adsorption mode at a timing corresponding to transport of successive sheets. In this way, sheets can be transported at a regular interval without providing an especially long inter-sheet interval especially for retrieving toner from the cleaning roller 42. In the present embodiment, this is achieved using a comparatively simple configuration.

In the present embodiment, the controller 105 controls the switch SW2 to switch the developing roller 55 into its operating condition while an electrostatic latent image confronts the developing position, that is, where the developing roller 56 contacts the photosensitive drum 20, and to switch into its non-operating condition while no electrostatic latent image confronts the developing position. At a timing corresponding to the inter-sheet interval, the laser scanner unit 30 is controlled not to form electrostatic latent images on the photosensitive drum 20 at non-image forming regions on which the cleaning roller 42 has released toner 53 during its release mode. Accordingly, residual toner 53 released from the cleaning roller 42 will be recovered by the developing roller 56 in its non-operating condition when no electrostatic latent image confronts the developing position.

Figure 11:
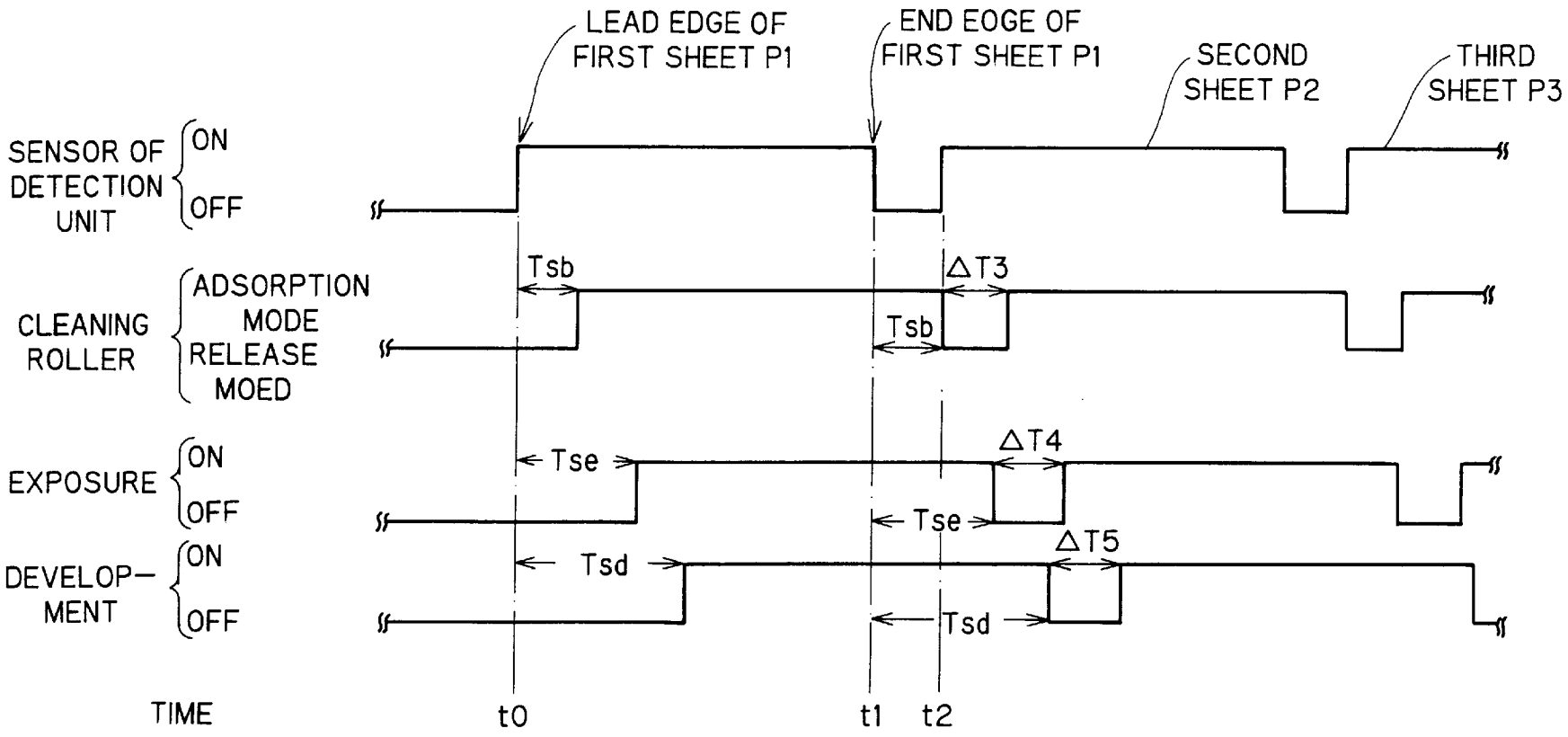
FIG. 11 is a timing chart showing timing of various operations during image forming processes in the laser printer according to a third embodiment of the present invention.

Next, while referring to the timing chart in FIG. 11 and the corresponding side views in FIGS. 12(*a*) through 12(*k*), an explanation will be provided for timing at which the device according to the third embodiment: switches the cleaning roller 42 between its adsorption mode and its release mode; controls the laser scanner unit 30 to form electrostatic latent images; and switches the developing roller 56 between its operating condition and its non-operating condition. In FIGS. 12(*a*) through 12(*k*), hashing is used to indicate the cleaning roller 42 when in its adsorption mode, the laser scanning unit 30 when performing exposure operations, and the developing roller 56 when performing development operations.

As shown in the timing chart in FIG. 11, the sensor of the detection unit 106 turns on and off upon detecting the lead portion and the end portion of sheets P. The cleaning roller 42 is switched between its adsorption mode and its release mode, the laser scanner unit 30 starts and stops performing exposure operations, and the developing roller 56 is switched between its operating condition and its non-operating condition all based the on and off condition of a sensor of the detection unit 106.

FIG. 12(*a*) shows a situation when the sensor of the detection unit 106 detects the lead portion of a first sheet P1 at timing t0 of FIG. 11. After a predetermined duration of time Tsb elapses after timing t0, the cleaning roller 42 is switched into its adsorption mode as shown in FIG. 12(*b*). Next, after a predetermined duration of time Tse elapses after timing t0, then the laser scanner unit 30 is turned on as shown in FIG. 12(*c*) and so performs exposure operations. Next, after a predetermined duration of time Tsd elapses from the timing t0, then as shown in FIG. 12(*d*), the developing roller 56 is switched on into its operating condition.

As shown in FIGS. 12(*a*) through 12(*d*), the predetermined durations of time Tsb, Tse, and Tsd are durations of time required for the lead portion of an image forming region on the surface of the photosensitive drum 20 to reach the leveling position, the exposure position, and the developing position, respectively based on the standard timing t0. The predetermined durations of time Tsb, Tse, and Tsd are determined based on: the distance between the sensor of the detection unit 106 and the transfer position where the transfer roller 60 contacts the photosensitive drum 20; the distance between the leveling position, the exposure position, and the developing position around the periphery of the photosensitive drum 20; and the rotational speed of the photosensitive drum 20.

In the example shown in FIG. 12(*a*) through 12(*k*), the leveling position and the developing position are disposed at positions approximately 140° from each other at the periphery of the photosensitive drum 20. The developing position and the transfer position are disposed at approximately 110° from each other at the periphery of the photosensitive drum 20. The transfer position and the leveling position are disposed at approximately 110° from each other at the periphery of the photosensitive drum 20. The photosensitive drum 20 rotates with a peripheral speed of 35 mm/sec and has an outer peripheral length of 30 mm×π=94 mm. With this arrangement of components, the predetermined duration of time Tsb is approximately 0.7 seconds, the predetermined duration of time Tse is approximately 1.5 seconds, the predetermined duration of time Tsd is approximately 2.0 seconds.

As shown in FIG. 12(*e*), the sensor of the detection unit 106 turns off at timing t1 upon detecting the end portion of the first sheet P1. After the predetermined duration of time Tsb elapses after the timing t1, then as shown in FIG. 12(*f*), the cleaning roller 42 is switched into its release mode. Next, after the predetermined duration of time Tse elapses after the timing t1, then, as shown in FIG. 12(*g*), the laser scanner unit 30 is turned off so exposure operations are stopped. As shown in FIG. 12(*g*), during the time interval Δ T3, the cleaning roller 42, which is in its release mode, releases residual toner 53*a* onto the surface of the photosensitive drum 20.

As shown in FIG. 12(*h*), at the end of the time interval Δ T3 (i.e., at timing t1+the predetermined duration of time Tsb+the time interval Δ T3), the cleaning roller 42 is again returned to its adsorption mode so that the residual toner will not adversary affect the image to be formed on the second sheet P2. Accordingly, the cleaning roller 42 stops releasing residual toner onto the surface of the photosensitive drum 20 at the end of the time interval Δ T3.

Next, as shown in FIG. 12(*i*), after the predetermined duration of time Tsd elapses after the timing t1, then the developing roller 56 is switched into its non-operating condition. Accordingly, the developing roller 42 starts recovering the residual toner deposited on the photosensitive drum 20 by the cleaning roller 42 during time interval t1.

Next, after the time interval Δ T4 elapses (i. e., at timing t1+time duration Tse+time interval Δ T4) after the laser scanner unit 30 was turned off, then the residual toner 53*a* released onto the photosensitive drum 20 by the cleaning roller 42 during the time interval Δ T3 will have already passed by the developing position of the laser scanner unit 30. Therefore, as shown in FIG. 12(*j*), the laser scanner unit 30 is turned on in order to form the electrostatic latent image for the second sheet P2 on the photo sensitive drum 20.

Finally, after time interval Δ T5 elapses (i.e., at timing t1+time duration Tsd+time interval Δ T5) from when the developing roller 53 was turned off, then the developing roller 56 is again turned on in order to develop the electrostatic latent image on the photosensitive drum 20 for the image of the second sheet P2. At this time, the developing roller 56 stops recovering residual toner 53*a* deposited on the photosensitive drum 20 by the cleaning roller 42 during time interval Δ T3.

In other words, the time intervals Δ T3, Δ T4, and Δ T5 correspond to the inter-sheet interval between successively-supplied first and second sheets P1 and P2, that is, to the non-image forming region of the photosensitive drum 20. The time durations Tsb, Tse, and Tsd correspond to the time required for the non-image forming region of the photosensitive drum 20 to reach the leveling position, the exposure position, and the development position, respectively after the sensor of the detection unit 106 detects the end edge of the first sheet P2 at the timing t1.

Because the end of the time interval Δ T3 (i. e., timing t1+time duration Tsb+time interval Δ T3) is after when the sensor of the detection unit 106 detects the front edge of the second sheet P at timing t2 and after the predetermined time duration Tsb, the end of the time interval Δ T4 (i. e., timing t1+time duration Tse+time interval Δ T4) is after when the sensor of the detection unit 106 detects the front edge of the second sheet P at timing t2 and after the predetermined time duration Tse, and the end of the time interval Δ T5 (i.e., timing t1+time duration Tsd+time interval Δ T5) is after when the sensor of the detection unit 106 detects the front edge of the second sheet P at timing t2 and after the predetermined time duration Tsd, therefore the interval between successive sheets P can be used with maximum efficiency so that residual toner can be returned from the cleaning roller 42 to the developing roller 56 while performing image forming operations continuously. As a result, the cleaning function and image forming speed can be maintained at a high level.

Subsequently, in the same manner, between detection of the end edge portion of an ith sheet Pi (wherein i=2, 3, . . . ) and detection of the lead portion of the i+1th sheet Pi+1: the cleaning roller 42 will release residual toner 53 onto the surface of the photosensitive drum 20 while the non-image forming region, which corresponds to the inter-sheet interval, passes by the leveling position; the laser scanner unit 30 will be turned off while the non-image forming region passes by the exposure position; and the developing roller 56 will be switched to its non-operating mode, so that developing operations will stop and the developing roller 56 will recover the residual toner 53 from the surface of the photosensitive drum 20, while the non-image forming region passes by the developing position.

Because a single turn's worth of the cleaning roller 42 is equal to or longer than the non-image forming region in the rotational direction of the photosensitive drum 20, during the time interval Δ T3, the toner accumulated on the cleaning roller 42 is released from around the entire periphery of the cleaning roller 42. As a result, when the cleaning roller 42 is again switched into its adsorption mode after the time interval Δ T3, then almost all the residual toner will have been released from the cleaning roller 42 so that the cleaning roller 42 will be in an optimum condition for adsorbing the toner from the surface of the photosensitive drum 20.

There is no need to periodically set an especially long inter-sheet interval exclusively for recovering toner from the cleaning roller 42. Residual toner is recovered between image forming operations at a timing corresponding to between supply of successive sheets so that image forming operations are not interrupted or interfered with. Therefore, image forming speed when images are formed on successively supplied sheets P will not reduced.

Because toner can be recovered in the middle of operations for forming images on successively supplied sheets P and because this is achieved by nearly control timing at which operations of various components are switched, the objectives of the present invention can be achieved with a relatively simple configuration.

Because the toner is recovered by utilizing the inter-sheet interval, toner can be recovered efficiently using the cleanerless method. The inter-sheet interval can be easily detected by detected position of the lead and end edges of supplied sheets. Toner can be efficiently adsorbed in the surface of the photosensitive drum because the photosensitive drum and the cleaning roller are rotated at different peripheral speeds.

While the invention has been described in detail with reference to specific embodiments thereof, it would be apparent to those skilled in the art that various changes and modifications may be made therein without departing from the spirit of the invention, the scope of which is defined by the attached claims.

Figure 13:
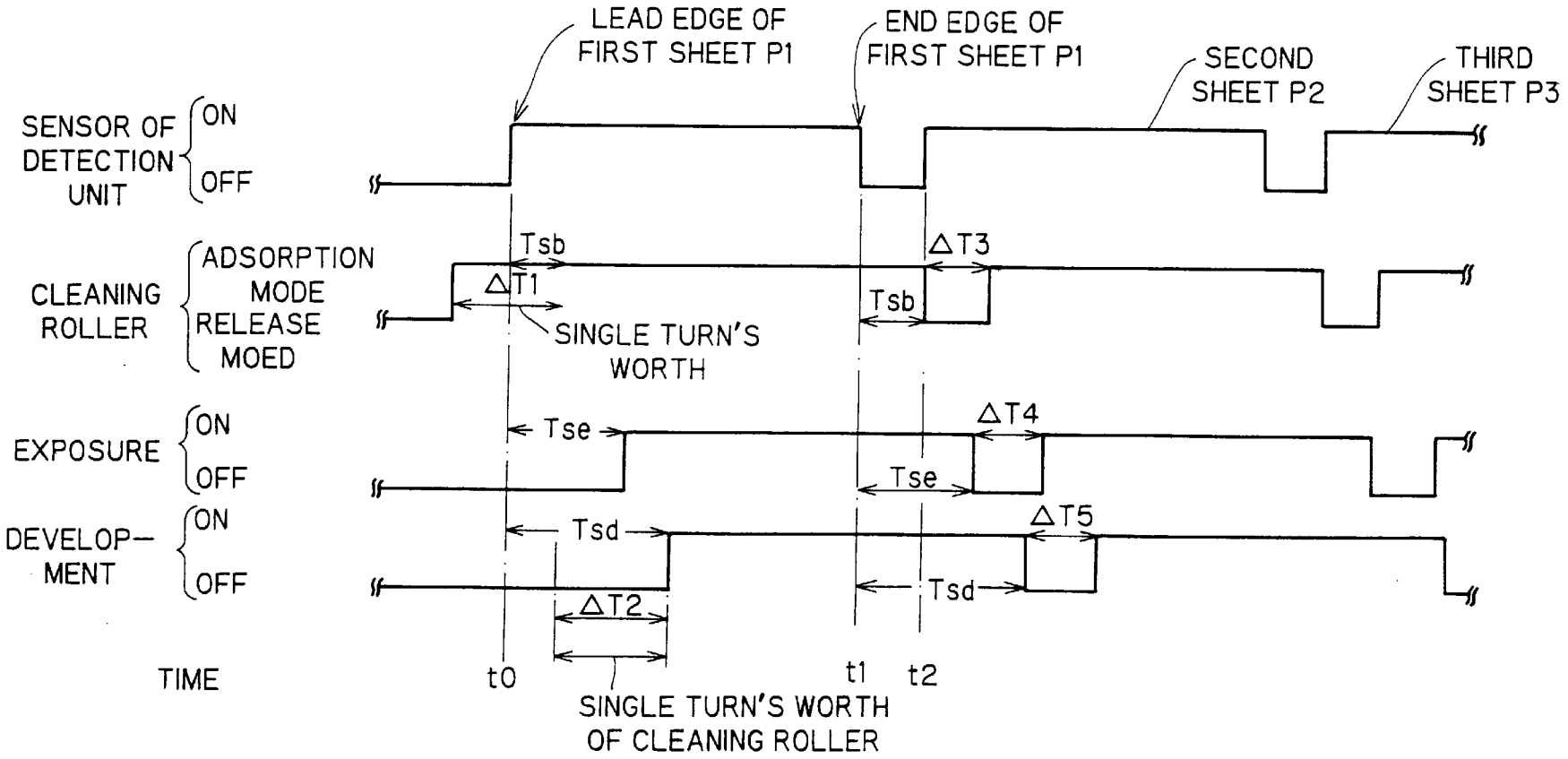
FIG. 13 is a timing chart showing timing of various operations during image forming processes in the laser printer according to a modification based on the first and third embodiments.

For example, an image forming device can be provided with the features described in both the first embodiment and the third embodiment. This case is shown in FIG. 13. When a lead edge of a first image forming region of the photosensitive drum 20, that is, an image region corresponding to the first sheet P1, is rotated to within at least the predetermined width distance from the leveling position, then the cleaning roller 43 is switched into its adsorption mode for the time duration Δ T1, which corresponds to a single turn's worth of the cleaning roller 43. At the end of the time duration Δ T1, that is, at the end of the time duration Δ T2, the developing roller 53 is turned on to start developing any electrostatic electric image formed on the first image forming region. The cleaning roller 43 is then switched back into its release mode when the end edge of the first image forming region is rotated into confrontation with the leveling position.

Then, with respect to the second and subsequent sheets P2 and on, the cleaning roller 43 is switched into its adsorption mode again for the time duration Δ T3 when a lead edge of the second and further image forming portions corresponding of the photosensitive drum 20 reaches the leveling position.

Although the above-described embodiments describe a device capable of forming only monochrome images, the present invention can be applied to image forming devices capable of forming color images. Although, the photosensitive body used in the image forming device of the embodiments is described as a photosensitive drum, a belt-shaped photosensitive body could be used instead. Also, the photosensitive drum and the developing roller could be driven to rotate in the same direction or in opposite directions. Although the embodiments describe the present invention applied to a laser beam printer, the present invention could be applied to any type of photoelectric image forming device which uses toner, for example, copy machines or facsimile machines.

What is claimed is:

1. An image forming device for forming an image on recording media from developing agent charged to a predetermined polarity, the image forming device comprising:

a photosensitive body that rotates in a rotational direction, the photosensitive body having first and second image forming portions where first and second electrostatic latent images corresponding to separate recording media are to be formed, the first and second image forming portions being separated by a predetermined distance;

a latent image forming unit that forms the first and second electrostatic latent images in the first and second image forming portions of the photosensitive body;

a developing unit that has a first operating condition, wherein the developing unit develops the first and second electrostatic latent images on the photosensitive body using the developing agent to form first and second developing agent images on the photosensitive body, and a second operating condition, wherein the developing unit recovers the developing agent from the photosensitive body;

a transfer unit that transfers the first and second developing agent images from the photosensitive body to the recording media;

a leveling unit disposed at a predetermined leveling position downstream from the transfer unit with respect to the rotational direction and having a width with respect to the rotational direction of the photosensitive body equal to or shorter than the predetermined distance, the leveling unit having an adsorption mode, wherein the leveling unit utilizes a potential difference between the leveling unit and the photosensitive body to adsorb along its width developing agent remaining on the photosensitive body after transfer operations by the transfer unit, and a release mode, wherein the leveling unit utilizes a potential difference between the leveling unit and the photosensitive body to release from along its width developing agent adsorbed during the adsorption mode onto the photosensitive body; and a switching unit that switches the leveling unit into its release mode so as to release toner from the entire width of the leveling unit onto the photosensitive body between the first and second electrostatic latent images and into its adsorption mode when each of the first and second electrostatic images are rotated to within a distance, equal to at least the predetermined distance from the leveling position.

2. An image forming device as claimed in claim 1, wherein the developing unit is disposed in confrontation with a development position of the photosensitive body and wherein the switching unit switches the developing unit from its second operating condition to its first operating condition when the first and second image forming portions of the photosensitive drum reaches the development position.

3. An image forming device as claimed in claim 2, further comprising a detection unit that detects a position of a lead portion of a recording medium; and wherein the switching unit switches, based on the position detected by the detection unit, the leveling unit into its adsorption mode when the corresponding image forming portion of the first and second image forming portions of the photosensitive body on which an image is to be formed with respect to the recording medium is rotated to within a distance, equal to at least the predetermined distance from the leveling position.

4. An image forming device as claimed in claim 1, wherein the leveling unit includes a cleaning roller disposed in confrontation with the photosensitive body at the leveling, position, the cleaning roller having a circumference equal to the predetermined distance.

5. An image forming device as claimed in claim 4, wherein the leveling unit includes a cleaning brush disposed in confrontation with the photosensitive body at the leveling position, the cleaning brush having a width with respect to the rotational direction equal to the predetermined width.

6. An image forming device as claimed in claim 5, further comprising a detection unit that detects a position of a lead portion of a recording medium and wherein the switching unit switches, based on the position detected by the detection unit, the leveling unit into its adsorption mode when the corresponding image forming portion of the first and second image forming portions of the photosensitive body on which an image is to be formed with respect to the recording medium is rotated to within a distance at least the predetermined width from the leveling position.

7. An image forming device as claimed in claim 1, wherein the leveling unit includes a cleaning brush disposed in confrontation with the photosensitive body at the leveling position, the cleaning brush having a width with respect to the rotational direction equal to the predetermined width.

8. An image forming device as claimed in claim 1, further comprising a detection unit that detects a position of a lead portion of a recording medium; and wherein the switching unit switches, based on the position detected by the detection unit, the leveling unit into its adsorption mode when the corresponding image forming portion of the first and second image forming portions of the photosensitive body on which an image is to be formed with respect to the recording medium is rotated to within at least the predetermined distance from the leveling position.

9. An image forming device for forming images on recording media from developing agent charged to a predetermined polarity, the image forming device comprising:

a photosensitive body that rotates in a rotational direction, the photosensitive body having first and second image forming portions where first and second electrostatic latent images corresponding to separate recording media are to be formed, the first and second image forming the portions being separated by a predetermined distance;

a latent image forming unit that forms first and second electrostatic latent images in the first and second image forming portions of the photosensitive body;

a developing unit that has a first operating condition, wherein the developing unit develops the first and second electrostatic latent images on the photosensitive body using the developing agent to form first and second developing agent images on the photosensitive body, and a second operating condition, wherein the developing unit recovers the developing agent from the photosensitive body;

a transfer unit that transfers the first and second developing agent images from the photosensitive body to the recording media;

a leveling unit having a predetermined width with respect to the rotational direction of the photosensitive body equal to or shorter than the predetermined distance and having an adsorption mode, wherein the leveling unit utilizes a potential difference between the leveling unit and the photosensitive body to adsorb along its width developing agent remaining on the photosensitive body after transfer operations by the transfer unit, and a release mode, wherein the leveling unit utilizes a potential difference between the leveling unit and the photosensitive body to release from along its width developing agent adsorbed during the adsorption mode onto the photosensitive body;

a detection unit that detects predetermined condition in the image forming device; and a mode controlling unit that, when the detection unit detects the predetermined condition, sets the leveling unit into its release mode for a first period of time corresponding to a rotation period of the photosensitive body equal to at least the predetermined distance and into its adsorption mode for a second period of time corresponding to a rotation period of the photosensitive body equal to at least the predetermined distance.

10. An image forming device as claimed in claim 9, wherein the detection unit detects, as the predetermined condition in the image forming device, correction of a recording medium jam condition in the image forming device.

11. An image forming device as claimed in claim 10, wherein the detection unit detects, as the predetermined condition in the image forming device, completion of image forming operations in the image forming device.

12. An image forming device as claimed in claim 11, further comprising a power supply source and wherein the detection unit detects, as the predetermined condition in the image forming device, turning on of the power supply source.

13. An image forming device as claimed in claim 12, wherein the developing unit is disposed in confrontation with the photosensitive body at a development position and enters its second operating condition mode at least while a portion of the photosensitive body operated on, as a result of the detection unit detecting the predetermined condition of the image forming device, by the leveling unit in the release mode and the adsorption mode is in confrontation with the development position.

14. An image forming device as claimed in claim 13, wherein the mode controlling unit, when the detection unit detects the predetermined condition, sets the leveling unit at least twice into its release mode for said first period of time corresponding to a rotation period of the photosensitive body equal to at least the predetermined distance and into its adsorption mode for said second period of time corresponding to a rotation period of the photosensitive body equal to at least the predetermined distance.

15. An image forming device as claimed in claim 9, wherein the detection unit detects, as the predetermined condition in the image forming device, completion of image forming operations in the image forming device.

16. An image forming device as claimed in claim 9, further comprising a power supply source and wherein the detection unit detects, as the predetermined condition in the image forming device, turning on of the power supply source.

17. An image forming device as claimed in claim 9, wherein the developing unit is disposed in confrontation with the photosensitive body at a development position and enters its second operating condition mode at least while a portion of the photosensitive body operated on, as a result of the detection unit detecting the predetermined condition of the image forming device, by the leveling unit in the release mode and the adsorption mode is in confrontation with the development position.

18. An image forming device as claimed in claim 9, wherein the mode controlling unit, when the detection unit detects the predetermined condition, sets the leveling unit at least twice into its release mode for said first period of time corresponding to a rotation period of the photosensitive body equal to at least the predetermined distance and into its adsorption mode for said second period of time corresponding to a rotation period of the photosensitive body equal to at least the predetermined distance.

19. An image forming device for forming images on recording media from developing agent charged to a predetermined polarity, the image forming device comprising:

a photosensitive body that rotates in a rotational direction, the photosensitive body having first and second image forming portions where first and second electrostatic latent images corresponding to separate predetermined recording media are to be formed, the first and second image forming portions being separated by a predetermined distance;

a latent image forming unit that forms the first and second electrostatic latent images in the first and second image forming portions of the photosensitive body;

a developing unit that has a first operating condition, wherein the developing unit develops the first and second electrostatic latent images on the photosensitive body using the developing agent to form first and second developing agent images on the photosensitive body, and a second operating condition, wherein the developing unit recovers the developing agent from the photosensitive body;

a transfer unit that transfers the first and second developing agent images from the photosensitive body to the recording media;

a leveling unit disposed at a predetermined leveling position downstream from the transfer unit with respect to the rotational direction of the photosensitive body and formed to have a width with respect to the rotational direction of the photosensitive body equal to or shorter than the predetermined distance, the leveling unit having an adsorption mode, wherein the leveling unit utilizes a potential difference between the leveling unit and the photosensitive body to adsorb along its width developing agent remaining on the photosensitive body after transfer operations by the transfer unit, and a release mode, wherein the leveling unit utilizes a potential difference between the leveling unit and the photosensitive body to release from along its width developing agent adsorbed during the adsorption mode onto the photosensitive body; and a switching unit for switching the leveling unit into its release mode so as to release toner from the entire width of the leveling unit onto the photosensitive body between the first and second electrostatic latent images and into its adsorption mode when a lead edge of the second electrostatic latent image reaches the leveling position.

20. An image forming device as claimed in claim 19, wherein the switching unit switches the leveling unit into its release mode when an end portion of an image forming portion of the first and second image forming portions of the photosensitive body reaches the leveling position.

21. An image forming device as claimed in claim 20, further comprising a detection unit that detects a position of the lead portion of a recording medium and wherein the switching unit determines when the lead edge of the corresponding image forming portion of the first and second image forming portions reaches the leveling position based on the position detected by the detection unit.

22. An image forming device as claimed in claim 21, wherein the developing unit is disposed in confrontation with the photosensitive body at a development position, the developing unit entering its first operating condition while the first and second image forming portions of the photosensitive drum formed with the first and second electrostatic latent images are at the development position and entering its second operating condition while the first and second electrostatic latent images are not at the development position.

23. An image forming device as claimed in claim 19, further comprising a detection unit that detects a position of the lead portion of a recording medium and wherein the switching unit determines when the lead edge of the corresponding image forming portion of the first and second image forming portions reaches the leveling position based on the position detected by the detection unit.

24. An image forming device as claimed in claim 19, wherein the developing unit is disposed in confrontation with the photosensitive body at a development position, the developing unit entering its operating condition while the first and second image forming portions of the photosensitive drum formed with the first and second electrostatic latent images are at the development position and entering its second operating condition while the first and second electrostatic latent images are not at the development position.

25. An image forming device as claimed in claim 19, wherein the leveling unit includes a cleaning roller disposed in confrontation with the leveling position on the photosensitive body.

26. An image forming device as claimed in claim 25, wherein the cleaning roller rotates at a peripheral speed different from peripheral speed of the photosensitive body.

27. An image forming device as claimed in claim 26, wherein the cleaning roller is formed with a circumference as long as or shorter than the predetermined distance.

28. An image forming device as claimed in claim 25, wherein the cleaning roller is formed with a circumference as long as or shorter than the predetermined distance.

29. An image forming device for forming an image on recording media from developing agent charged to a predetermined polarity, the image forming device comprising:

a photosensitive body that rotates in a rotational direction, the photosensitive body having first and second image forming portions where first and second electrostatic latent images corresponding to separate recording media are to be formed the first and second image forming portions being separated by a predetermined distance;

a latent image forming unit that forms the first and second electrostatic latent images in the first and second image forming portions on the photosensitive body;

a developing unit that has a first operating condition, wherein the developing unit develops the first and second electrostatic latent images on the photosensitive body using the developing agent to form first and second developing agent images on the photosensitive body, and a second operating condition, wherein the developing unit recovers the developing agent from the photosensitive body;

a transfer unit that transfers the first and second developing agent images from the photosensitive body to the recording media;

a leveling unit disposed at a predetermined leveling position downstream from the transfer unit with respect to the rotational direction of the photosensitive body, the leveling unit having a predetermined width with respect to the rotational direction of the photosensitive body equal to or shorter than the predetermined distance, the leveling unit having an adsorption mode, wherein the leveling unit utilizes a potential difference between the leveling unit and the photosensitive body to adsorb along its width developing agent remaining on the photosensitive body after transfer operations by the transfer unit, and a release mode, wherein the leveling unit utilizes a potential difference between the leveling unit and the photosensitive body to release from along its width developing agent adsorbed during the adsorption mode onto the photosensitive body; and a switching unit that switches the leveling unit into its adsorption mode when the first electrostatic latent image forming region of the photosensitive body is rotated to within at least the predetermined width distance from the leveling position, that switches the leveling unit into its release mode so as to release toner from the entire width of the leveling unit onto the photosensitive body between the first and second electrostatic latent images when an end edge of the first electrostatic latent image forming portion of the photosensitive body reaches the leveling position, and that switches the leveling unit into its adsorption mode when a lead edge of the second electrostatic latent image reaches the leveling position.

30. An image forming device as claimed in claim 29, wherein the switching unit switches the leveling unit into its adsorption mode when a lead edge of a subsequent image forming portion, which is subsequent to the second image forming portion, reaches the leveling position.

* * * * *